US012766431B2

(12) United States Patent
Russell

(10) Patent No.: US 12,766,431 B2
(45) Date of Patent: Oct. 20, 2026

(54) INTERLOCKING FORMS FOR MAKING SAND STRUCTURES, KITS WITH INTERLOCKING FORMS AND METHOD OF USE

(71) Applicant: SMTC UG, Hamburg (DE)

(72) Inventor: Hugh Russell, Hamburg (DE)

(73) Assignee: SMTC UG, Hamburg (DE)

( * ) Notice: Subject to any disclaimer, the term of this patent is extended or adjusted under 35 U.S.C. 154(b) by 387 days.

(21) Appl. No.: 18/381,278

(22) Filed: Oct. 18, 2023

(65) Prior Publication Data

US 2025/0128181 A1 Apr. 24, 2025

(51) Int. Cl.
*A63H 33/32* (2006.01)

(52) U.S. Cl.
CPC ..... *A63H 33/32* (2013.01)

(58) Field of Classification Search
CPC ..... A63H 33/32; A63H 33/001
USPC ..... 446/70, 85; 249/165, 166; 425/DIG. 57
See application file for complete search history.

(56) References Cited

U.S. PATENT DOCUMENTS 1,248,532 A * 12/1917 Noyes ..... B29C 45/006 425/DIG. 57
1,306,761 A * 6/1919 Heminger ..... B22C 9/06 249/170
1,543,389 A * 6/1925 Knight ..... A22C 7/0046 249/168
1,610,121 A * 12/1926 Dickinson ..... A63H 33/001 425/DIG. 57
1,639,934 A * 8/1927 Ferring ..... A63H 33/001 425/DIG. 57
1,886,486 A * 11/1932 Bryant ..... A63H 33/001 249/104
2,458,728 A * 1/1949 Plhak ..... A63H 33/32 425/DIG. 57
2,831,231 A * 4/1958 Toensing ..... E02D 5/523 249/48
3,059,279 A * 10/1962 Rossi ..... A63H 33/32 249/55
3,691,672 A * 9/1972 Pendill ..... A63H 33/044 446/70
4,164,341 A * 8/1979 McComb ..... A63H 33/001 249/126
4,171,791 A * 10/1979 Britz ..... B28B 7/16 249/168

(Continued)

FOREIGN PATENT DOCUMENTS

CN 106760507 5/2017
DE 3610652 10/1987

(Continued)

*Primary Examiner* — Alexander R Niconovich
(74) *Attorney, Agent, or Firm* — Millen, White, Zelano & Branigan, P.C.; Christopher W. Brody

(57) ABSTRACT

A sandcastle building system includes interlocking forms that allow users to build various tower and wall shapes, thereby providing endless creative possibilities. Each interlocking forms has a non-removable connecting or locking pin that facilitates connecting one interlocking form to an adjacent form. Each form has a surface that is configured to impart a design on sand surrounded by the forms to create a castle-look once the forms are removed. The forms can also include an anchor peg assembly that allows the forms to be stabilized in sand when the sand castle is being built.

19 Claims, 28 Drawing Sheets

(56) References Cited

U.S. PATENT DOCUMENTS 5,255,888 A * 10/1993 Workman ..... E04G 13/021 249/168
5,720,614 A * 2/1998 Pestano ..... A63H 33/32 434/82
5,851,415 A * 12/1998 Thomas ..... A23G 9/221 249/117
5,895,304 A * 4/1999 Dixon ..... A63H 33/32 446/85
6,126,876 A * 10/2000 Demarzo ..... A63H 33/32 264/109
6,176,464 B1 * 1/2001 Harvey ..... F25C 1/22 249/126
7,273,573 B2 * 9/2007 Racunas, Jr. ..... B44C 3/06 425/DIG. 57
9,474,986 B2 * 10/2016 Drylie ..... A63H 33/001
9,694,297 B2 * 7/2017 McMahon ..... B28B 7/0014
10,010,804 B1 * 7/2018 Jung ..... A63H 33/001
10,080,979 B2 * 9/2018 Lane ..... A63H 33/32
11,408,187 B2 * 8/2022 Lane ..... E04G 9/02
11,918,933 B2 * 3/2024 Colayco ..... A63H 33/32
11,959,288 B2 * 4/2024 Lane ..... A63H 33/32
12,371,915 B1 * 7/2025 Henry ..... F25C 3/00
2008/0251687 A1 * 10/2008 Taufield ..... A63H 33/32 249/61
2008/0251688 A1 * 10/2008 Rajusth ..... A21B 3/131 249/169
2013/0069265 A1 * 3/2013 Djoboulian ..... E04G 11/22 264/33
2016/0114254 A1 * 4/2016 Diaz ..... A63H 33/001 249/126
2024/0316474 A1 * 9/2024 Lane ..... A63H 33/32

FOREIGN PATENT DOCUMENTS

DE 3610652 A1 * 10/1987 ..... A63H 33/32
DE 19947487 4/2001
EP 0807728 11/1997
EP 1426526 6/2004
EP 1447496 4/2017
FR 2684019 A1 * 5/1993 ..... A63H 33/32
GB 166789 A * 7/1921 ..... A63H 33/32
JP 2013-108336 6/2013

* cited by examiner

INTERLOCKING FORMS FOR MAKING SAND STRUCTURES, KITS WITH INTERLOCKING FORMS AND METHOD OF USE

FIELD OF THE INVENTION

A sand structure building system includes a number of different kinds of interlocking forms, which can be interconnected for building a sand structure. Each interlocking form include female connectors, and a locking pin intended to remain with the interlocking form and facilitate connection of adjacent forms.

BACKGROUND

Traditional sandcastle building methods have long relied on the use of plastic buckets or molds, which often present limitations and frustrations for enthusiasts. One of the key challenges with these methods is the issue of sand getting stuck in the bucket when attempting to upend it. This not only disrupts the building process but also hinders the ability to create intricate and detailed sandcastle structures.

Moreover, traditional bucket-shaped molds impose restrictions on the shapes and forms that can be created, limiting the creative possibilities. Sandcastle enthusiasts are often left desiring more flexibility and freedom to construct complex architectural features as well as complete interconnected structures.

To address these limitations and offer an improved sandcastle building experience, the present invention introduces a revolutionary approach with its interlocking form system.

SUMMARY OF THE INVENTION

The present invention relates to a novel sandcastle building system designed to overcome the limitations of traditional methods. This innovative system introduces a set of interlocking forms that enable enthusiasts to create sandcastles of remarkable complexity and intricacy.

The interlocking forms are available in a variety of shapes, allowing for the construction of diverse architectural elements such as towers, walls, gatehouses and more. These forms interlock at various angles, providing endless possibilities for designing unique and captivating sand structures.

One of the notable advantages of this system is the ease of connecting and disconnecting the forms. With a simple yet robust mechanism, users can effortlessly join the forms together to build larger structures or disassemble them for reconfiguration. This promotes creativity and encourages exploration of different architectural arrangements.

By utilizing the interlocking form system, sandcastle enthusiasts are liberated from the limitations imposed by traditional bucket-shaped molds. The frustration of sand getting stuck in the bucket when upending it becomes a thing of the past. The forms allow for seamless sand placement and removal, ensuring a smooth and enjoyable building experience.

The sandcastle building system presented herein revolutionizes the art of sandcastle construction. Its interlocking forms, available in various shapes and angles, empower enthusiasts to unleash their creativity and build extraordinary sand structures with ease. The system's versatility, user-friendly design, and innovative features make it a groundbreaking tool for sandcastle enthusiasts of all ages.

A base component of the sand structure building system is an interlocking form that is designed to be connected to other interlocking forms to create one or more spaces to receive sand for sand structure building, preferably sand castles. The interlocking form includes a body portion having opposing first and second end portions and first and second surfaces. In order to simulate the structure of a castle or other structure once the forms are connected, sand fills the spaces formed by the connected interlocking forms, and the forms are removed, one of the first and second surfaces has first protrusions extending therefrom to simulate a structure wall, e.g., a stone or block-like castle wall. The protrusions extend into the sand filled in the space to create a three dimensional look of the wall of a structure.

The body portion also includes a first end portion that has first and second spaced apart female connectors and a second end portion that has third and fourth spaced apart female connectors. The connectors are designed to engage with spaces in other interlocking forms to connect the interlocking forms together using a locking pin that is retained in one of the female connectors so that it can slide between a retracted state to allow engagement between two adjacent interlocking forms and a lowered state, wherein the locking pin extends into the female connectors of the adjacent interlocking form and the one remaining connector of the interlocking form containing the locking pin. More particularly, the locking pin has a top portion, body portion, and end portion, the body portion sized to slide in the opening in the first female connector and in the opening in the second female connector such that the end portion can extend from a bottom of the second female connector when the locking pin is in the lowered state and be positioned in the opening of the first female connector when the locking pin is in a retracted state.

Means are provided for retaining the end portion of the locking pin in the opening in the first female connector to keep the locking pin and body portion together when the interlocking form is used for sand castle building.

The body portion can have a straight shape or a curved shape, with interlocking forms having both shapes used for sand structure building. The interlocking forms with the straight shape body portion can be connected together to form a straight length of the structure. These interlocking forms can also be connected together to form a 90 degree corner of the structure or connected together in angles other than 90 degrees. The interlocking forms having a curved shape for the body portion can also be used for a corner application with straight interlocking forms or used together to form a round turret for the sand structure.

One example of a retaining means to keep the locking pin with the interlocking form includes the locking pin having a slot, the slot having a bottom surface. A moveable protrusion is provided in the first female connector, the moveable protrusion having a ramp terminating at a free end portion of the moveable protrusion. The ramp and free end portion extend into the opening in the first female connector. Movement of the moveable protrusion allows the end portion and body portion of the locking pin to pass through the opening in the first female connector with the end portion sliding over the ramp and moving the moveable protrusion out of the way. Once the end portion of the locking pin slides over the moveable protrusion, the moveable protrusion moves back to its at rest state, with the free end portion of the moveable protrusion extending into the opening again of the female connector. The free end portion of the moveable protrusion is then positioned to engage the bottom surface of the slot to retain the end portion of the locking pin in the first female connector and prevent its removal from the first female connector. With this means, the locking pin is part of the interlocking form and is readily available to facilitate connection between adjacent interlocking forms and there is no worry of the locking pin getting lost.

The locking pin can also include means for holding the locking pin in the first female connector when the locking pin is in the retracted state and means for holding the locking pin in the first female connector when the locking pin is in the lowered state.

One example of a retracted state holding means is a first rib positioned in the slot near the end portion of the locking pin and configured to engage the ramp of the moveable protrusion to prevent the locking pin from moving to the lowered state once in the retracted state.

One example of a lowered state holding means is a second rib positioned in the slot near the top portion of the locking pin and configured to engage the free end portion of the moveable protrusion to prevent the locking pin from moving to the retracted state once in the lowered state. The ribs are sized so that, upon application of a force on the locking pin, the ribs can travel past the moveable protrusion so that so that the locking pin can be moved to the lowered state for interlocking form connections.

The surface opposed to the surface of the body portion having the sand structure wall emanating protrusions can have additional protrusions to provide additional strength for the body portion.

The interlocking form can also include an anchor peg assembly that allows an anchor peg to penetrate sand forming the base of the sand structure to help keep the interlocking forms in a vertical orientation. The anchor peg assembly includes an anchor peg housing mounted to the other of the first and second surfaces of the body portion. The anchor peg housing has a slot to slidably receive an anchor peg, the anchor peg capable of extending from the slot to extend beyond a bottom of the body portion and penetrate sand to provide stability to the interlocking form. Means can be provided to retain the anchor peg in a storage position when not needed and means for keeping the anchor peg in the slot once inserted therein.

The locking pin has a polygonal shape that prevents rotation of locking pin when engaged in the female connectors of the interlocking forms. The polygonal shape, preferably an octagonal one, also facilitates connecting adjacent interlocking forms in angled configurations rather than in an in line configuration. The anti-rotation feature of the polygonal locking pin in combination with the shape of the openings in the female connectors keeps the selected alignment of adjacent interlocking forms in place.

The invention also includes a sand structure building kit that is made up of a plurality of the interlocking forms. The kit can include a first set of interlocking forms each having a straight body portion, a second set of interlocking forms, each having a curved body portion, and a third set of interlocking forms. The third set of interlocking forms are sized so that two smaller sized interlocking forms are connected together, this would match the length of a single full size interlocking form. The forms can then be used to build a sand structure by selecting various forms and connecting them together, filling the space or spaces created by the connected forms, and then disconnecting the forms from one another, separately or when partially disconnected, and removing them from the sand-filled spaces so as to create a sand structure.

The kit can include other component parts to improve the sand structure building and provide an additional sand structure door feature. One of the additional components that can be used when building a sand structure is brace that is designed to connect to two locking pins to keep the interlocking forms having the locking pins in a more vertical orientation and resist the tendency for sand to cause the interlocking forms to lean. The kit can include a number of braces, with each brace having a connector on each end. Each connector is configured to engage the top portion of a locking pin to brace spaced apart interlocking forms.

Another component part of the kit can be a tunnel assembly, which, when used, creates a through opening in the sand with door or gate-like look in the sand adjacent the through opening. The tunnel assembly includes a first section having a first flange at an end thereof and a first tunnel portion, one side of the first flange having protrusions to simulate the door opening and a second section having a second flange at an end thereof and a second tunnel portion, one side of the second flange having protrusions to simulate another door opening. Each of the first and second sections also include a clip that is configured to engage a bottom of an interlocking form. The second tunnel portion is sized to fit within the first tunnel portion and the two sections clipped respectively to opposing interlocking forms. Once sand is filled in the space between the interlocking forms and containing the tunnel assembly, each interlocking form and each tunnel section can be removed from the sand to leave both an opening in the sand and a door-like look around the opening.

The invention also includes a method of constructing a sand structure using the interlocking forms of the kit described above. With the kit, one can connect at least some of the interlocking forms of the kit together by engaging the locking pin of selected interlocking forms of the kit with female connectors of other selected interlocking forms of the kit. The connected interlocking forms can be arranged in virtually any way to create one or more spaces with the first or second surface having the first protrusions facing the one or more spaces. With the selected interlocking forms connected, the space or spaces created can be filled with sand. The connected interlocking forms can then be disconnected to leave a sand structure such as a sand castle if the interlocking forms are configured to simulate castle walls. The method can also include the use one or more of the braces found in the kit as well as one of more of the tunnel assemblies. An advantage of the interlocking form configuration is that it allows disassembly with some of the interlocking forms still connected. For example, a wall made up of five interlocking forms could be removed by disconnecting the locking pins at the ends of the wall, thus, avoiding the need to retract each locking pin for each interlocking form for disassembly.

DETAILED DESCRIPTION OF THE INVENTION

Figure 1:
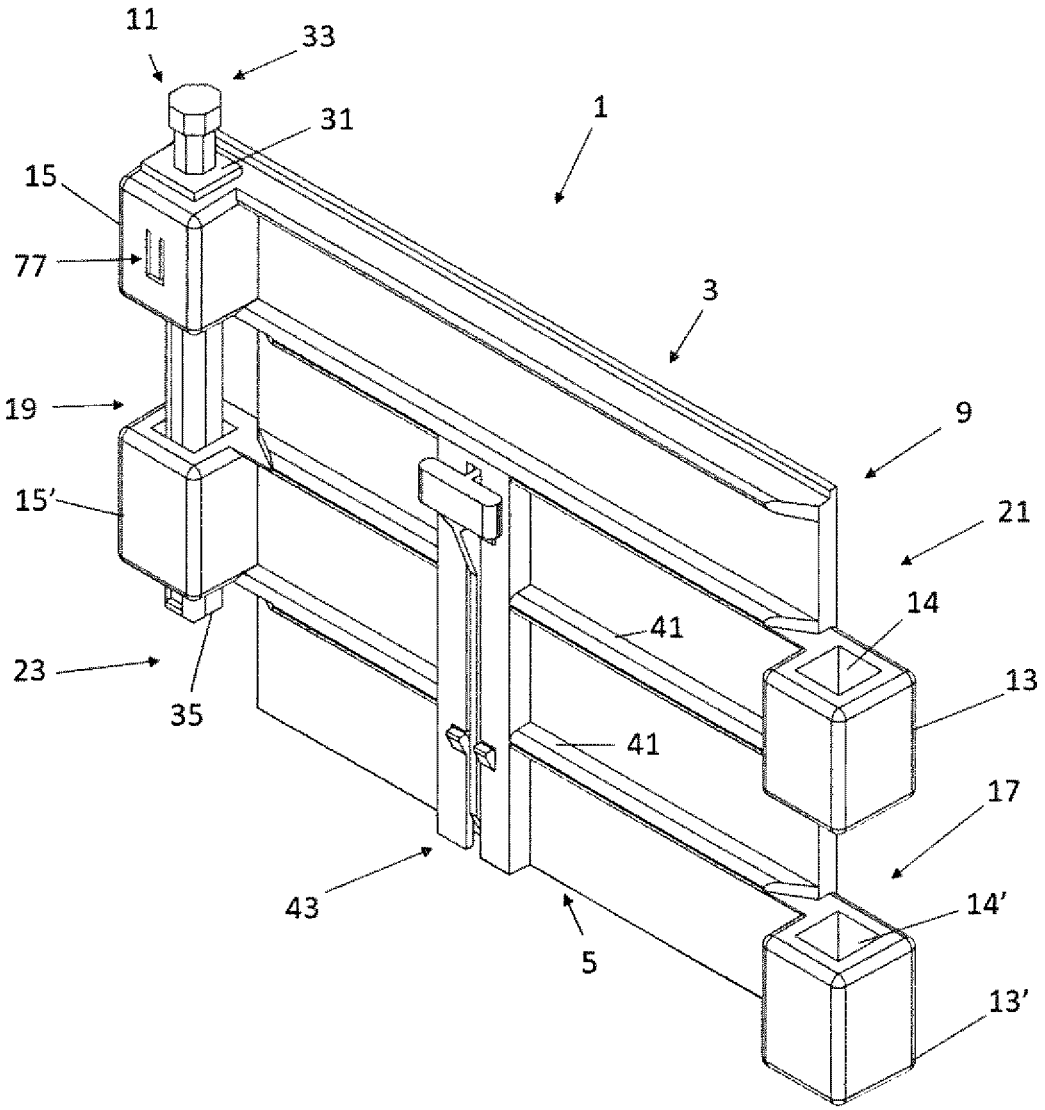
FIG. 1 shows a top and rear side perspective view of one kind of an interlocking form of the inventive sandcastle building system
Figure 2:
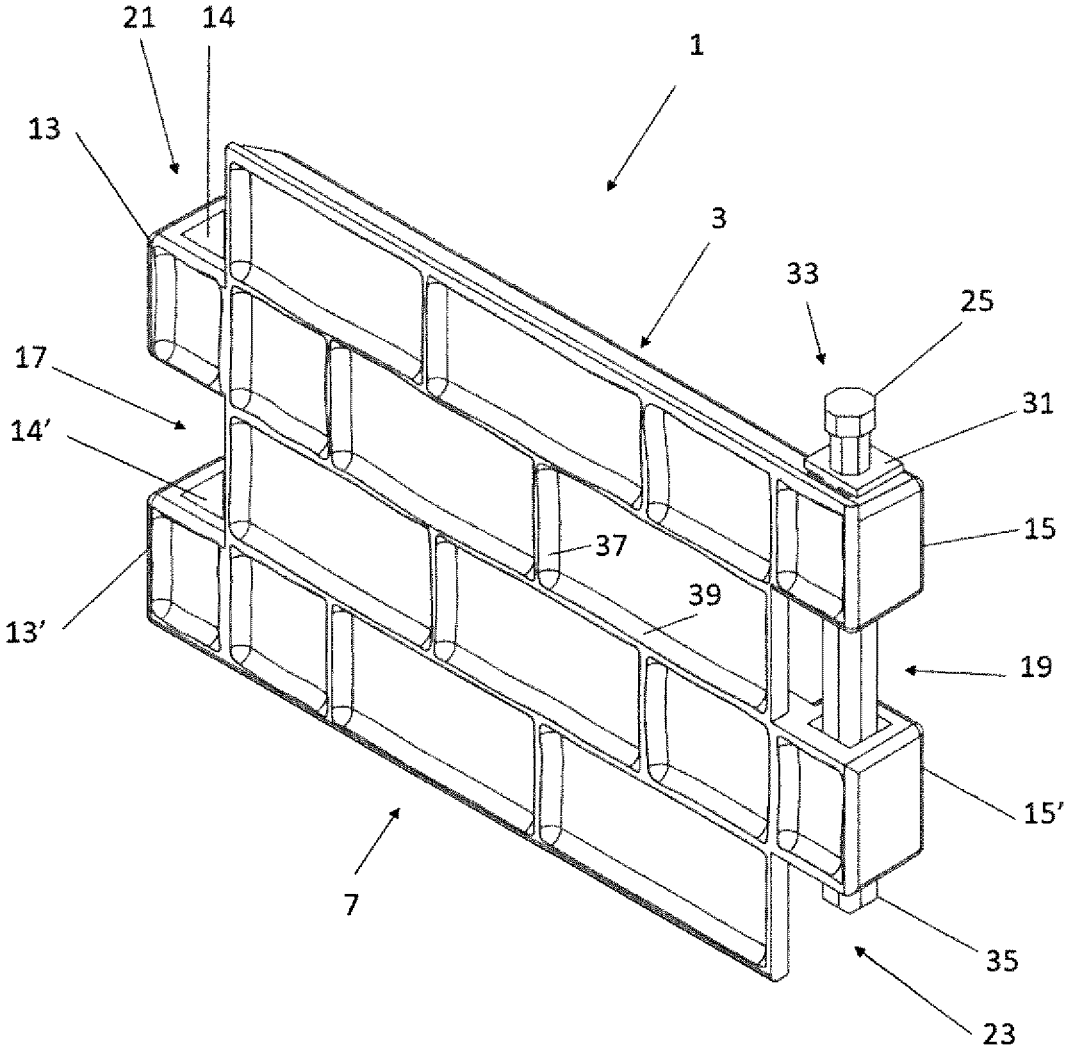
FIG. 2 shows a top and front side perspective view of the interlocking form of FIG. 1.

The sandcastle building system consists of interlocking forms, each featuring female connectors on opposite ends. One end of the form has a connecting or locking pin inserted into the top female connector. The pin is secured inside the top female connector to prevent complete removal. The female connectors on the other end of the form are aligned to allow easy connection with other instances of the form. This interlocking mechanism enables the construction of sandcastles in different shapes and sizes.

The combination of the female connectors and the locking pin provides a sturdy and stable connection, ensuring the structural integrity of the sandcastle. The forms can be assembled and disassembled effortlessly, allowing for easy customization and modification of sandcastle designs. The connecting or locking pins are pulled up and the forms can then be easily pulled away from the sand structure.

In certain forms of the sandcastle building system, an additional feature called the "anchor peg" is incorporated. The anchor peg serves as a helpful tool to maintain the shape and stability of the form while it is being filled with sand. The peg is designed to be pushed down into the sand, securing the form in place and preventing shifting or collapsing during the sand filling process. This innovative addition ensures that the sandcastle structure maintains its intended shape, allowing for precise and accurate construction. The anchor peg is easily inserted and removed, providing convenience and flexibility during the sandcastle building process and has a retention feature so that, while moveable, stays engaged with the interlocking form to prevent loss thereof.

Referring now to FIGS. 1-3A, one aspect of the invention in terms of building sand castles is an interlocking form 1 that includes a body portion 3 having first and second surface 5 and 7 and end portions 9 and 11. End portion 9 includes a pair of female connectors 13, 13' and end portion 11 includes a pair of female connectors 15, 15'. Each pair of female connectors 13, 13' are spaced from each other to create a space 17, which is designed to receive a female connector from another and adjacent interlocking form for connection between the two adjacent forms. Similarly, each pair of female connectors 15, 15' are spaced from each other to create a space 19 for a similar connection to an adjacent interlocking form. The pair of female connectors 13 and 13' also respectively include openings 14 and 14'.

Another space 21 exists above the female connector 13, this space 21 intended to be occupied by a female connector of an adjacent interlocking form for attachment purposes. Similar to the arrangement of the connectors 13 and 13', the female connector 15' has a space 23 below it to facilitate connection with the female connector of an adjacent interlocking form.

In order to allow adjacent interconnecting forms to interconnect, the female connector 13 aligns horizontally with the space 19 of an adjacent interlocking form 1 and the connector 13' aligns horizontally with the space 23 of the adjacent interlocking form. Likewise, the female connector 15 aligns horizontally with the space 21 of an adjacent interlocking form and the female connector 15' aligns horizontally with the space 17 of the same adjacent interlocking form. In this way, the connector 15 of an adjacent interlocking form 1 can occupy the space 21 and the female connector 15' of the same adjacent interlocking form can occupy the space 17.

Figure 3A:
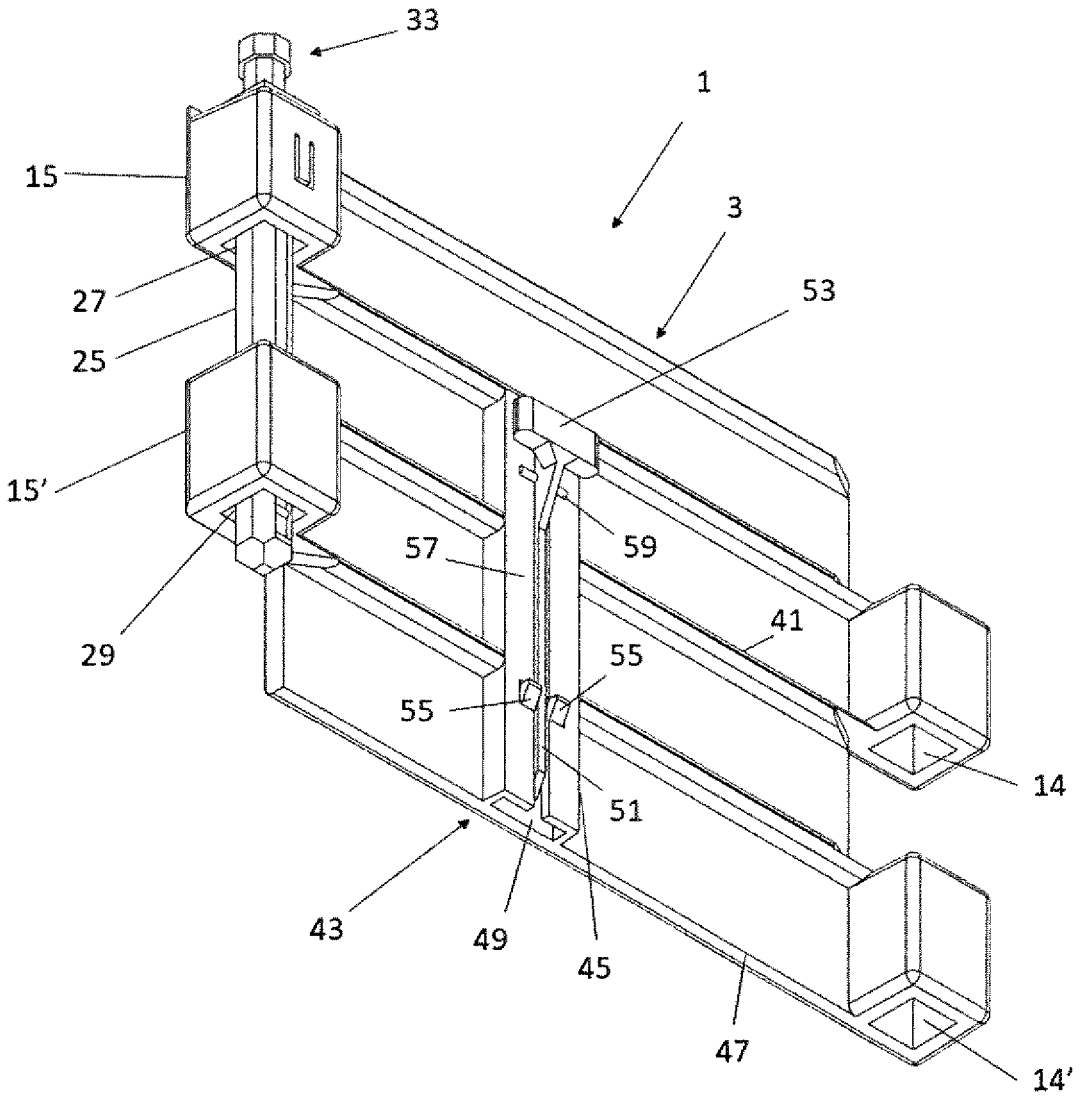
FIG. 3A shows an enlarged bottom and front side perspective view of the interlocking form of FIG. 1.
Figure 8:
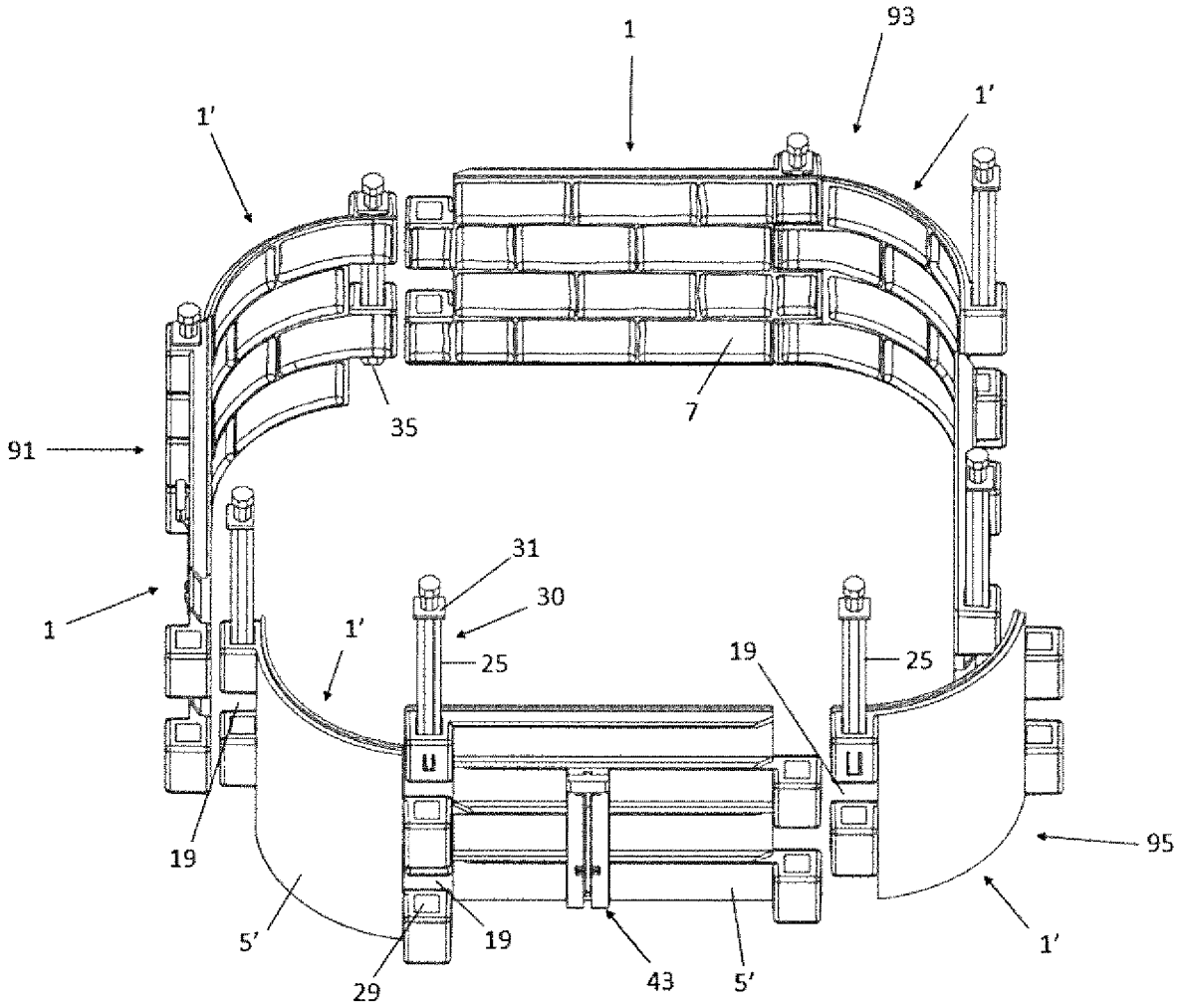
FIG. 8 shows the arrangement of interlocking forms of FIG. 7 in a partially disconnected state.

The interlocking form 1 also includes a connecting or locking pin 25, that is designed to extend through the female connectors 15 and 15'. With reference to FIG. 3, the locking pin 25 is designed to slide in the opening 27, see FIG. 3, in the female connector 15 and in and out of the opening 29 in the female connector 15'. The locking pin 25 has two states of positioning. A first state is a retracted state as best seen in FIG. 8, and designated by the reference numeral 30. This retracted state allows disconnection of two adjacent interlocking forms 1 that were connected or allows the two adjacent interlocking forms to be connected by engagement of the connectors of one interlocking form and spaces of another interlocking form along with movement of the locking pin 25 into a connection position. In the retracted state, the locking pin 25 is raised upwardly so that it removed from the opening 29 in the female connector 15' and is also clear of the space 19 between the two female connectors 15 and 15'.

The second state for the locking pin 25 is a lowered or connection state, wherein the locking pin 25 is positioned in both the openings 27 and 29 of the two female connectors 15 and 15'. Before being placed in the lowered state though, the female connectors 13 and 13' of an adjacent interlocking form 1 are positioned respectively in the spaces 19 and 23. The locking pin 25 is then lowered such that is passes through the opening 14 of the female connector of an adjacent interlocking form 1 that occupies space 19, passes through the opening 29 in the female connector 15', and extends into the opening 14' in the female connector 13' that occupies the space 23.

The locking pin 25 includes a stop 31 that limits downward travel of the locking pin 25 through the opening 27 in the female connector 15. The presence of the stop 31 also allows an upper portion 33 of the locking pin 25 to extend beyond the upper end of the female connector 15. The end portion 35 of the locking pin 25 extends below the bottom of the female connector 15' when the locking pin is the locking or extended position. The extent of the end portion 35 below the bottom of the female connection 15' is such that the opening 14' in the female connector 13' is only partially filled with the end portion 35 of the locking pin 25. This partial filling leaves a lower portion of the opening 14' in the female connector 13' still open to receive the upper portion 33 of the locking pin of an adjacent interlocking connection that would be placed beneath the one interlocking connector to create a stacked pair of interlocking forms. When two interlocking forms 1 are attached together, the lower portions of openings 14' of two female connectors 13' would be exposed at both ends 9 and 11 of the body portion 3 of the interlocking form 1. The two lower portions of the openings 14' can then receive the exposed locking pin upper portions 33 of an interlocking form beneath the interlocking form 1 with the exposed lower portions of the openings 14'.

Figure 13:
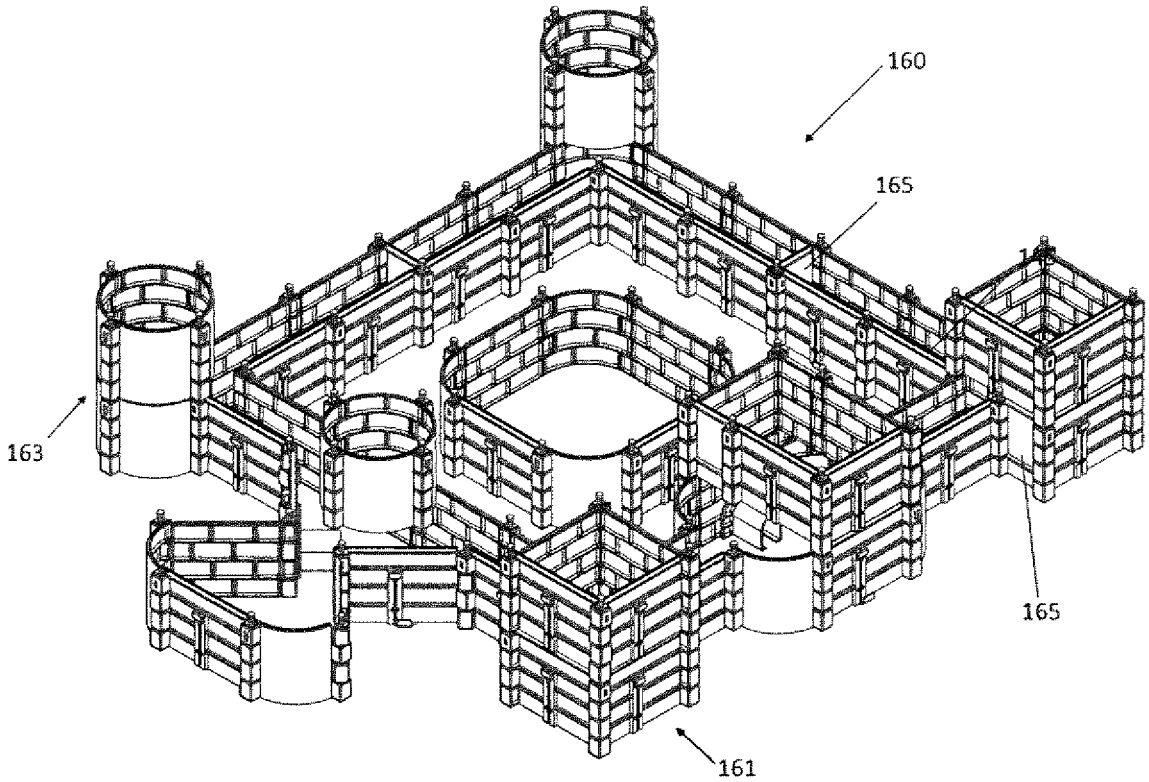
FIG. 13 shows another example of a more complex arrangement of interlocking forms of the invention.

Similarly, for the interlocking form 1 in FIG. 1, stacking another interlocking form onto the one depicted in FIG. 1 would result in the locking pin upper portion 33 engaging the lower portion of the opening 14' in the female connector 13' that is not filled with the lower end 35 of the locking pin 25 of the interlocking form 1 to be stacked onto the interlocking form 1 of FIG. 1. The stacked arrangement of the interlocking forms is best seen in FIG. 13 as explained in more detail below.

Still referring to FIGS. 1-3A, the second surface 7 is configured to represent a brick or block like structure having vertical protrusions 37 and horizontal protrusions 39 for forming an outside surface of a sand castle made from a number of interlocking forms 1. This configuration is only exemplary and other configurations can be used to represent the outer surface of a castle wall or another kind of building.

The first surface 5 includes horizontal ribs 41 that provide a stiffening effect for the body portion 3 to resist forces against the body portion by sand placed within a plurality of interlocking forms 1 used to form a sand castle. As with the second surface, the use of horizontal ribs 41 is only one example of structure that would improve the strength of the body portion and other structure could be employed, e.g., intersecting ribs forming squares, rectangle, diamond shapes, and the like.

With reference to FIGS. 1, 3A, 3B, and 7, the first surface 5 can also include a means for maintaining the shape and stability of the interlocking forms while a plurality of interlocking forms are connected together to form a space to be filled with sand to create a sand castle. This means includes a member that can extend past a bottom of the interlocking form that is resting on sand and penetrate the sand for stability. The means is illustrated as an anchor peg assembly 43, which is arranged on the first surface 5 of the body portion 3 so that is accessible when constructing the sand castle, see FIGS. 1 and 3, in particular. The anchor peg assembly 43 includes a peg housing 45 that extends upwardly from a bottom 47 of the interlocking form. While a single anchor peg assembly 43 is shown, more than one could be employed. While the anchor peg assembly 43 is shown generally in the middle of the body portion 3, it can be located at any point along the body portion 3.

Figure 3B:
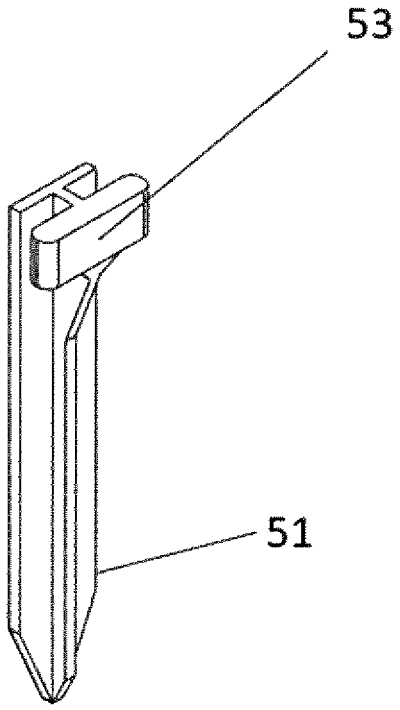
FIG. 3B shows the peg that is shown in FIG. 3 as part of a peg anchoring assembly.
Figure 3C:
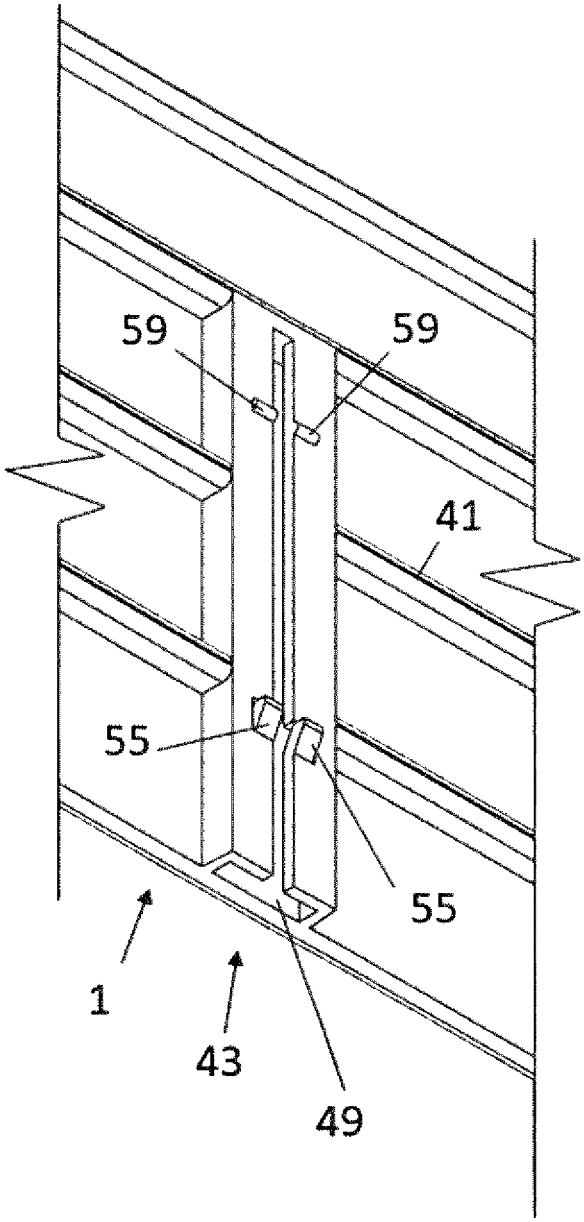
FIG. 3C shows a partial perspective view of an interlocking form showing the peg assembly without the peg.

The peg housing 45 includes a slot 49 that is sized to receive a peg 51, see FIG. 3B, the peg 51 having a peg head 53 that is shaped to facilitates grabbing and moving the peg 51 up and down. The peg housing 45 also includes a pair of ramps 55 extending outwardly from a front surface 57 of the peg housing 45. The ramps 55 are located near a bottom of the peg housing 45 and are designed to engage the peg head 53 to prevent further travel of the peg 51 in the slot 49. The peg housing 45 also includes a second pair of stops 59, which are designed to retain the peg 51 in the retracted state. The stops 59 are sized so that the peg head 53 can ride over the stops given a sufficient amount of applied force to move the peg 51 downward for sand engagement. Likewise, the peg head 53 can travel over the stops 59 when the peg 51 is retracted, with the stops 59 preventing the peg head 51, once in the totally retracted state, from sliding down in the slot 49 due to gravity.

Figure 7:
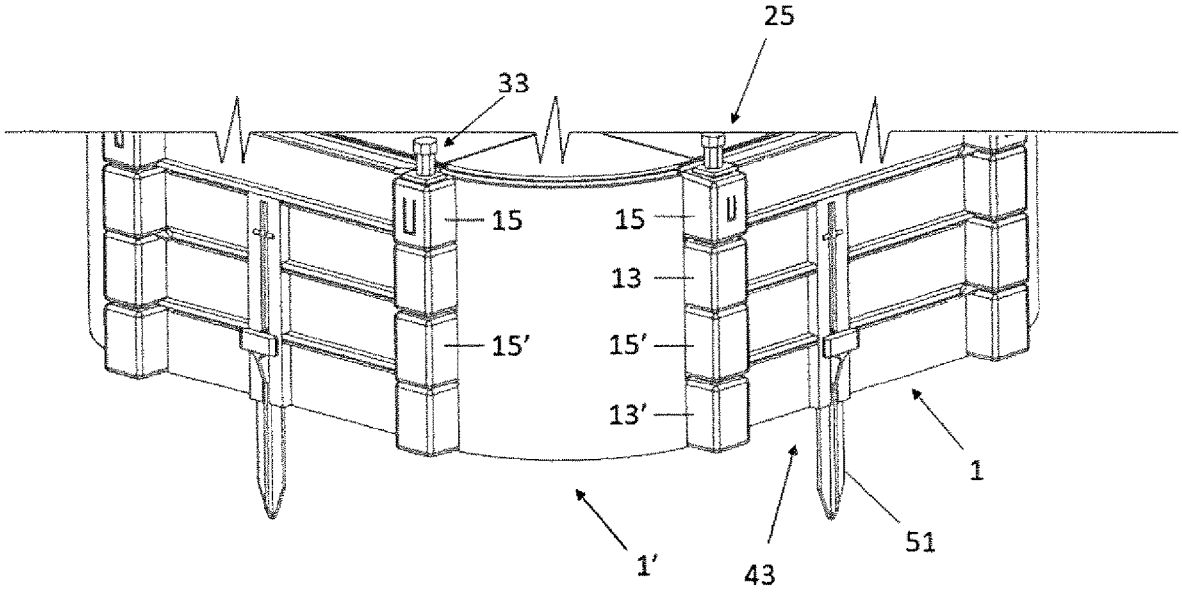
FIG. 7 shows a partial view of the interlocking form of the inventive sandcastle building system with the anchor pegs extended.

FIG. 3A shows the peg 51 in the retracted state and FIG. 7 shows the peg in an extended state, wherein a lower portion of the peg can penetrate sand to stabilize the interlocking form 1 having the peg housing assembly 43 as well as contribute to stabilization of other interlocking forms that may be connected to the stabilized interlocking form.

Figure 4A:
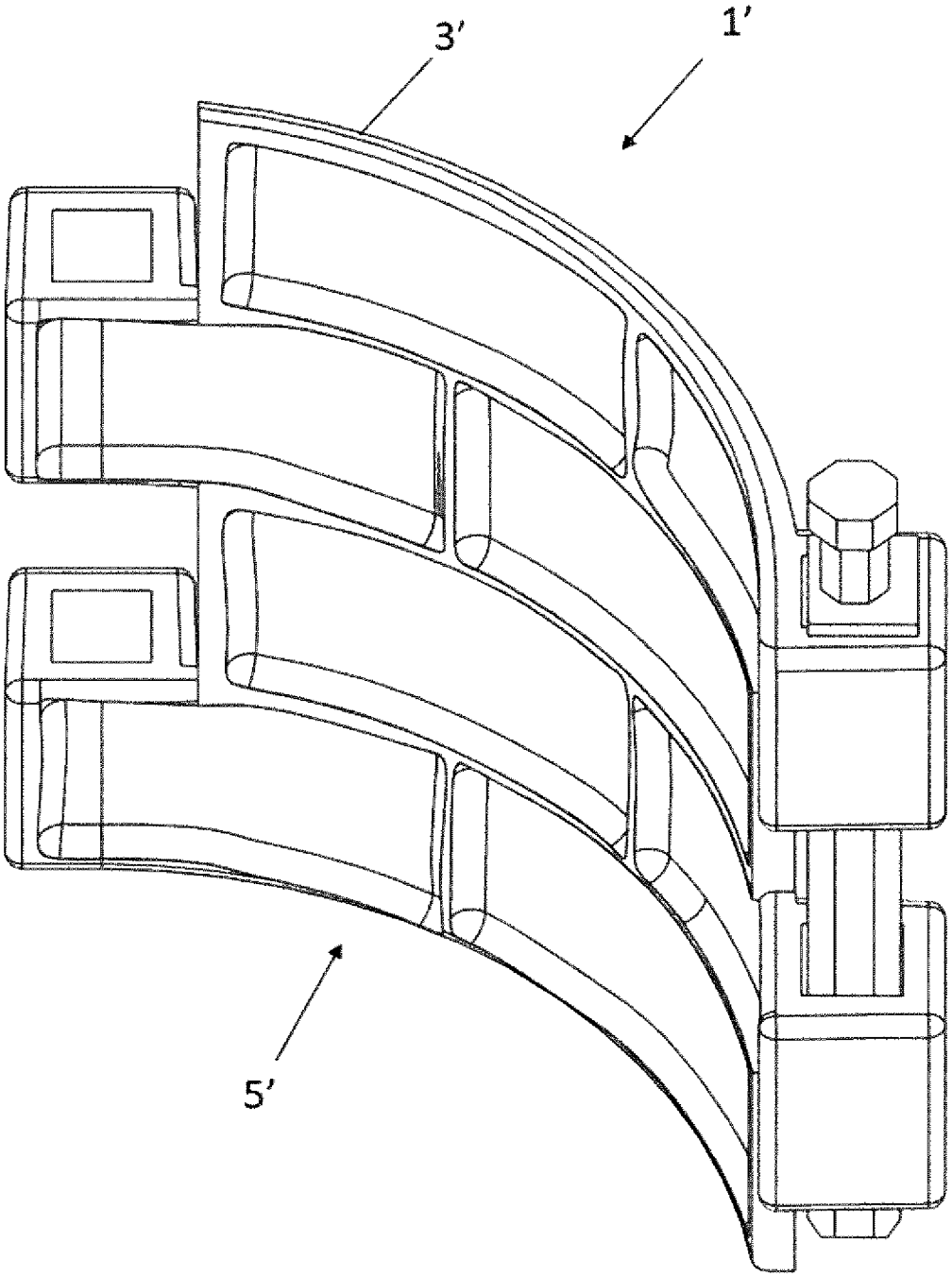
FIGS. 4A and 4B show perspective front and rear sides, respectively, of an example of another interlocking connector of the sandcastle building system.
Figure 4B:
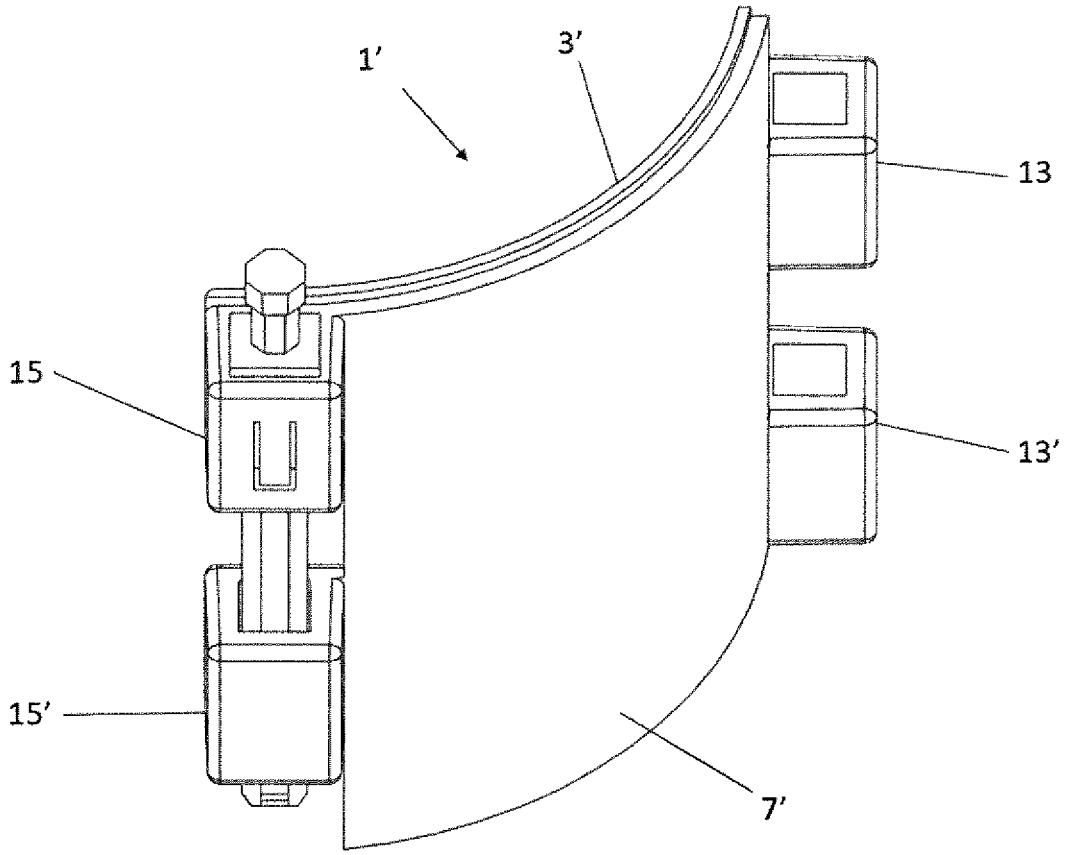

Other styles of interlocking forms are shown in FIGS. 4A to 5B. FIGS. 4A and 4B shows an interlocking form 1', which has a curved body portion 3'. The inner surface 5' has the same configuration as the inner surface 5 shown in FIG. 1 so as to impart a castle wall look on the sand when pressed up against the surface 5'. The outer surface 7' is shown without any additional protrusions or the like as is the case for the outer surface 7 shown in FIG. 2. While strengthening protrusions could be used, the curved shape of the body portion 3' alone provides sufficient strength against forces from sand pressing on the inner surface 5'. The arrangement of the connectors and locking pin is the same as that shown in FIGS. 1 and 2 and the interlocking form 1' could be attached to the straight interlocking form 1 in the same was as two straight interlocking forms 1 would be attached together.

Figure 5A:
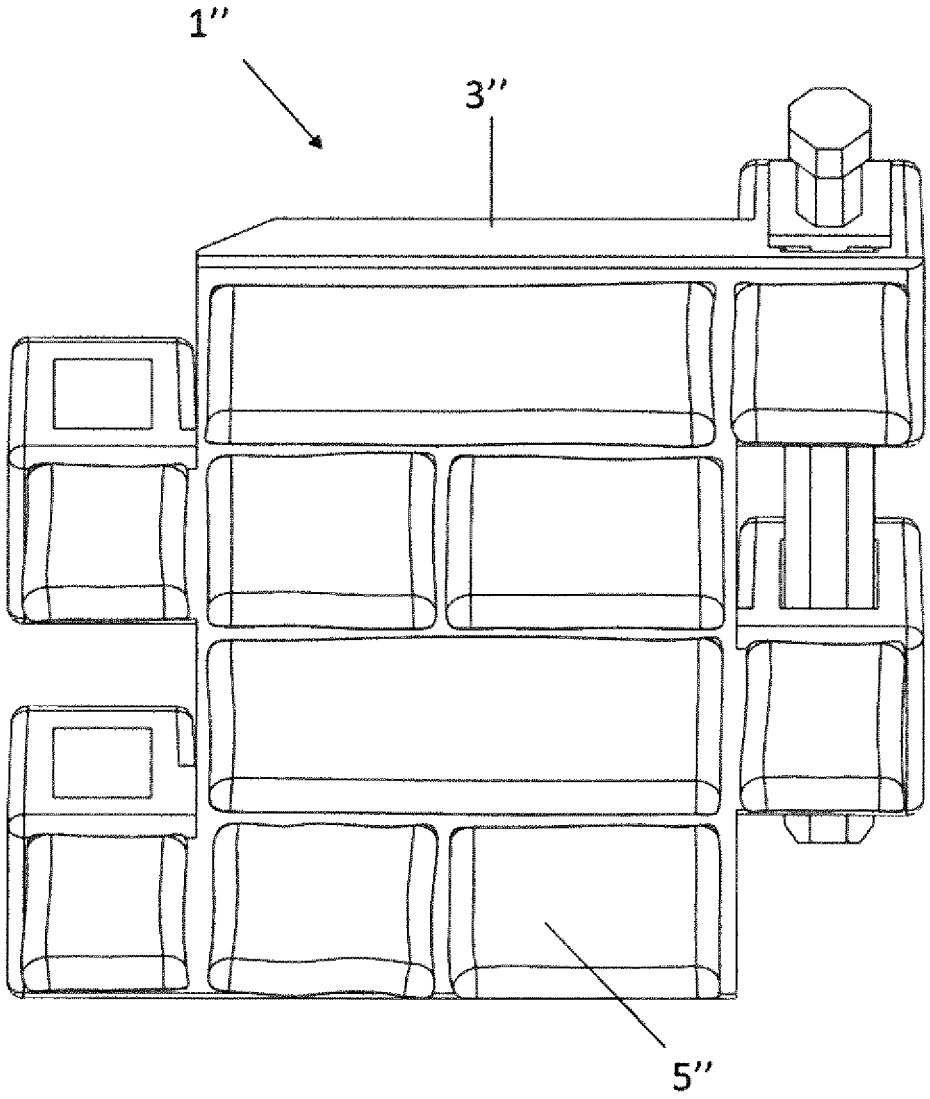
FIGS. 5A and 5B show perspective front and rear sides, respectively, of an example of yet another type of interlocking connector of the sand castle building system.
Figure 5B:
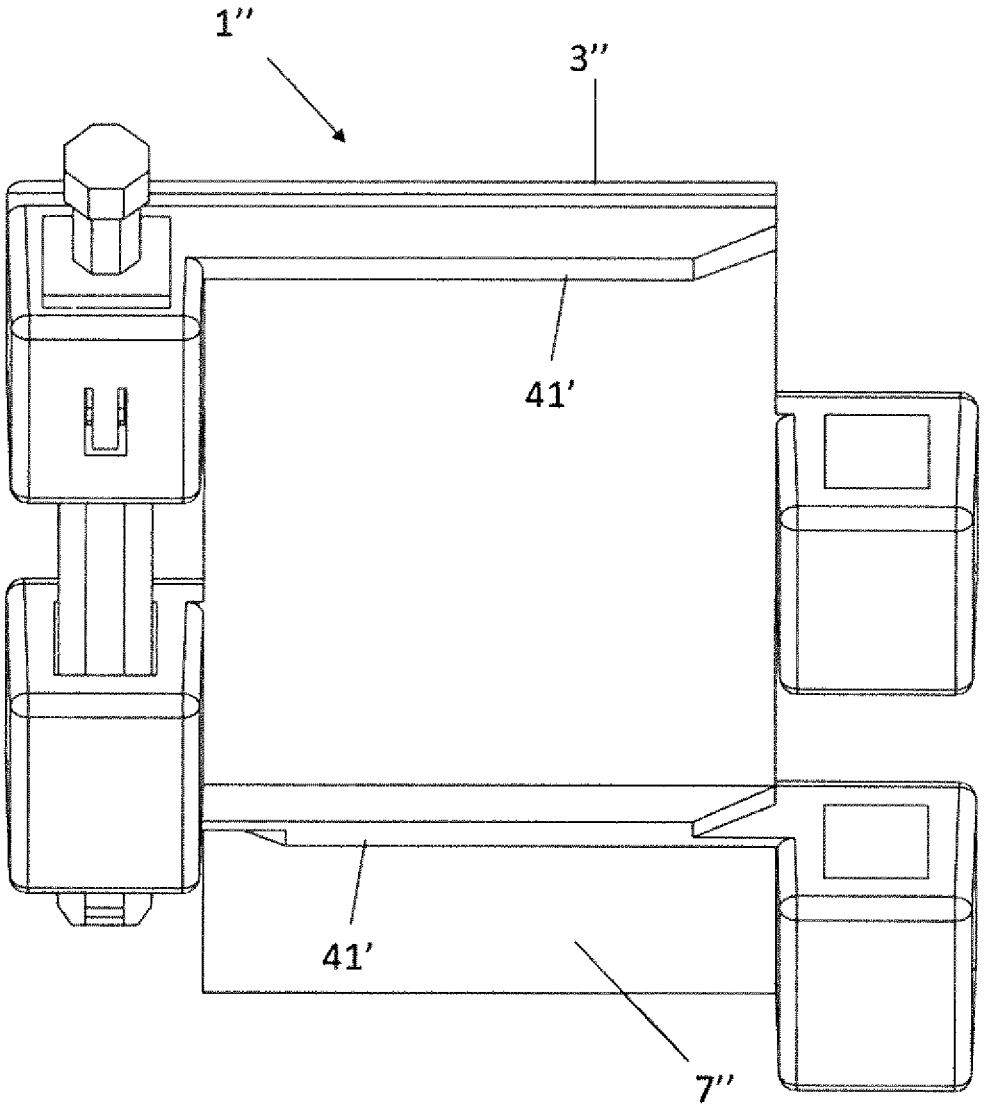

FIGS. 5A and 5B show another type of interlocking form designated by the reference numeral 1". This interlocking form 1" has a castle wall looking inner surface 5", similar to that shown in FIGS. 1 and 4A. The outer surface 7" in FIG. 5B is shown with ribs 41', which are similar to the ribs used in the interlocking form 1 of FIG. 1. The body portion 3" is designed so that when two forms 1" are connected parallel to each other, the horizontal distance between connector 15" on the leftmost form 1" and connector 14 on the rightmost form 1" is equal to the distance between the connectors 15 and 14 on the full size form 1. The half size interlocking form 1" allows more flexibility when interconnecting the various forms for creating a mold shape for sand castle creation.

The inventive interlocking form also has a means for preventing the locking pin 25 being removed from the female connector 15. With this means, the locking pin cannot get lost and remains with the interlocking form 1, either as part of a kit of a plurality of interlocking forms, each including a locking pin, or as part of an assembled set of interlocking forms when making a sand castle.

FIGS. 6A-6E show the detail of the locking pin 25 and the means for keeping the locking pin in place with respect to the female connector 15 in terms of features on the locking pin and features associated with the female connector 15. The locking pin 25 includes a slot 63 on one side thereof, the slot 63 cooperating with a feature on the female connector described below to allow the locking pin 25 to slide in the female connector 15 and move in and out of the female connector 15'.

Figure 6A:
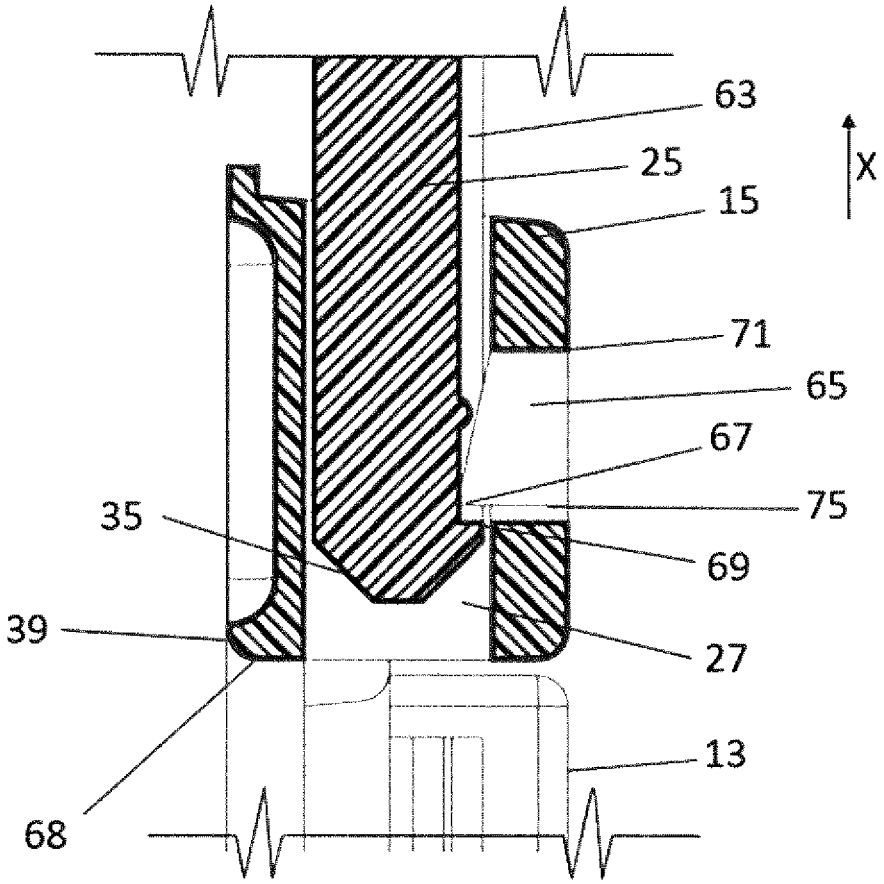
FIG. 6A shows a partial longitudinal cross sectional view of the locking pin engaged in its female connector.

With reference to FIG. 6A, which shows a partial longitudinal sectional view of the locking pin 25 in the female connector 15 in the retracted state, the female connector 15 includes a moveable protrusion 65 that extends into the opening 27 of the female connector 15 to a sufficient degree to engage the slot 63 in the locking pin 25. With the moveable protrusion 65 in the slot 63, the locking pin 25 is prevented from further movement in the upward direction by contact between a surface 67 of the protrusion and a bottom surface 69 of the slot 63, the upward movement represented by the arrow X in FIG. 6A.

Figure 6B:
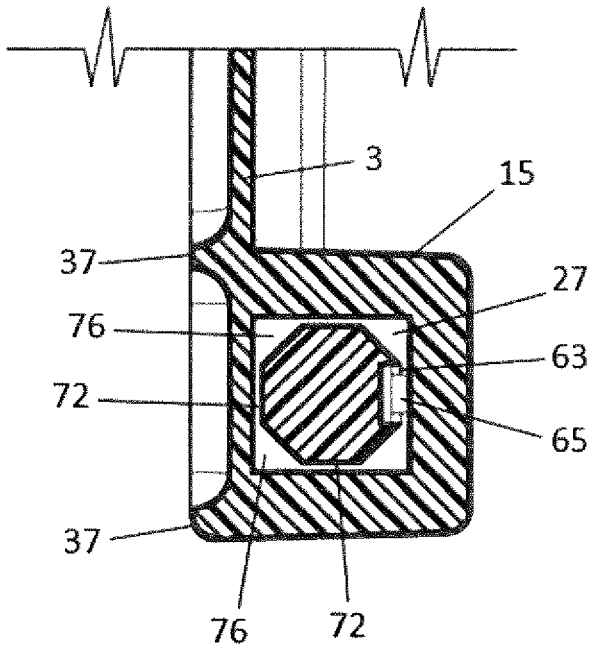
FIG. 6B shows a partial transverse cross sectional showing the locking pin engaged in its female connector.

FIG. 6B show a transverse sectional view of the female connector 15, locking pin 25, slot 63, and protrusion 65. This shows the octagonal shape of the locking pin, such shape deterring rotation of the locking pin 25 and maintaining engagement between the slot 63 and movable protrusion 65. While an octagonal shape is used for anti-rotation purposes, other polygonal shapes or configurations of the locking pin and/or opening 27 in the female connector 15 can be employed to prevent rotation of the locking pin 25. The functionality of the polygonal shape of the locking pin is also discussed below in connection with FIG. 6I.

Figure 6C:
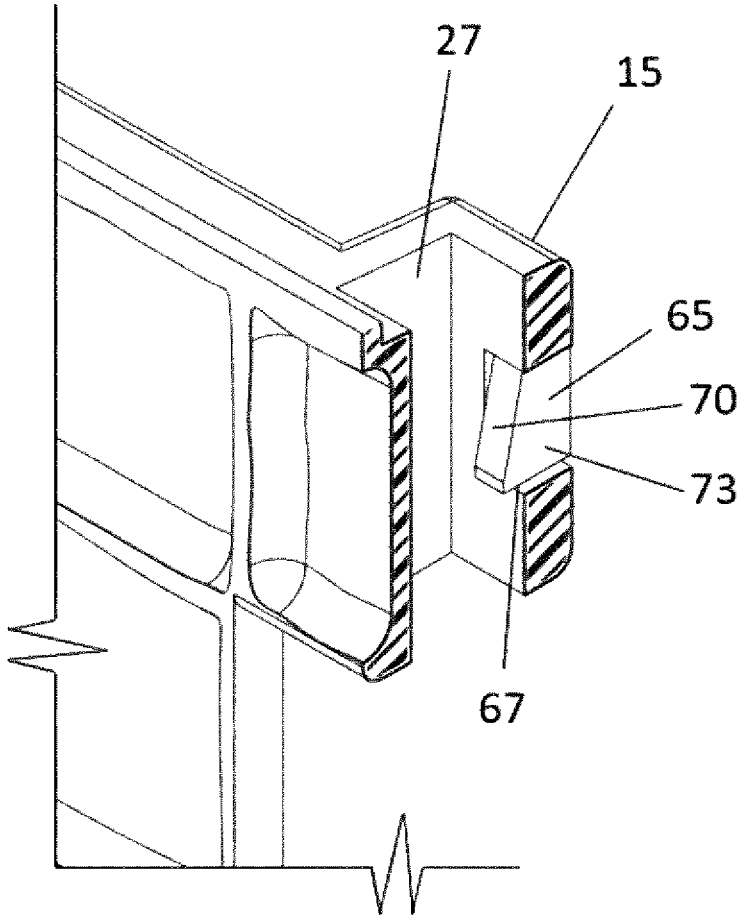
FIG. 6C shows a partial longitudinal cross sectional of a female connector showing protrusion for preventing removal of the locking pin.
Figure 6D:
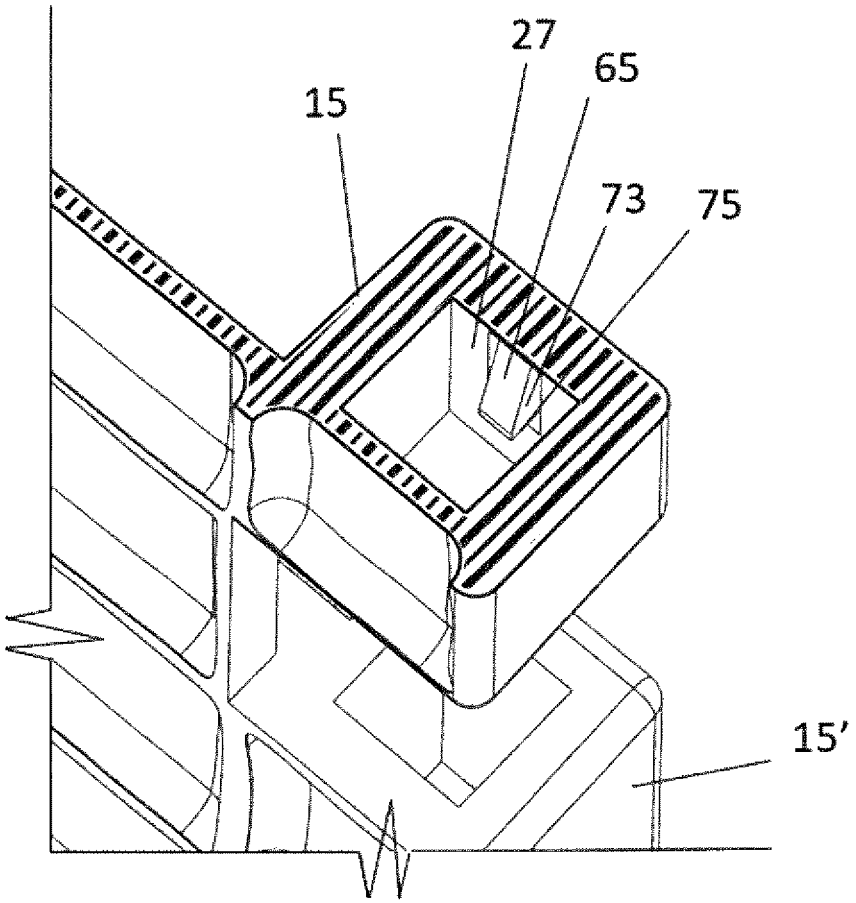
FIG. 6D shows a partial perspective transverse cross section view of the female connector shown in FIG. 6C.

FIG. 6C shows another vertical and perspective sectional view of the female connector 15. The protrusion 65 has a ramp 70 which allows the locking pin 25 to be placed into the female connector 15 from an upper end with the proper orientation so that the slot 63 of the locking pin 25 is aligned with the protrusion 65. With further sliding of the end portion 35 of locking pin 25 downward through the female connector opening 27, the end portion 35 of the locking pin 25 slides over the ramp 70 as the protrusion 65 moves away from the opening 27, thereby allowing the protrusion to engage the slot 63. Once the end portion 35 passes the protrusion 65 and the protrusion engages the slot 63, the locking pin 25 is prevented from being fully retracted from the female connector 15.

The moveable nature of the protrusion 65 is accomplished by the protrusion 65 being attached to the female connector 15 at an upper end portion 71 thereof, see FIG. 6A. However, the sides 73 and bottom 75 of the protrusion are spaced from the female connector 15, see FIGS. 6A and 6C, thus forming a u-shaped space 77, see FIG. 1. By having the protrusion connected at its upper end portion 71 but free from portions of the female connector at the protrusion's sides 73 and bottom 75, the protrusion can move or bias outwardly to accommodate the lower end 35 of the locking pin contacting the ramp 69 during locking pin insertion into the opening 27 of the female connector. After the end portion 35 passes the protrusion 65, the protrusion biases back into its locking state as shown in FIG. 6A to retain the locking pin 25 in place.

With reference to FIG. 6A again, when the locking pin 25 is located in the female connector in the fully retracted state, the end portion 35 of the locking pin 25 when engaged with the protrusion 65 remains in the opening 27 in the female connector 15 and does not extend beyond a lower face 68 of the female connector 15. This ensures that the end portion 35 does not enter the space 19 between the two female connectors 15 and 15' and the space 19 is open to receive a female connector 13 of another interlocking form.

Figure 6E:
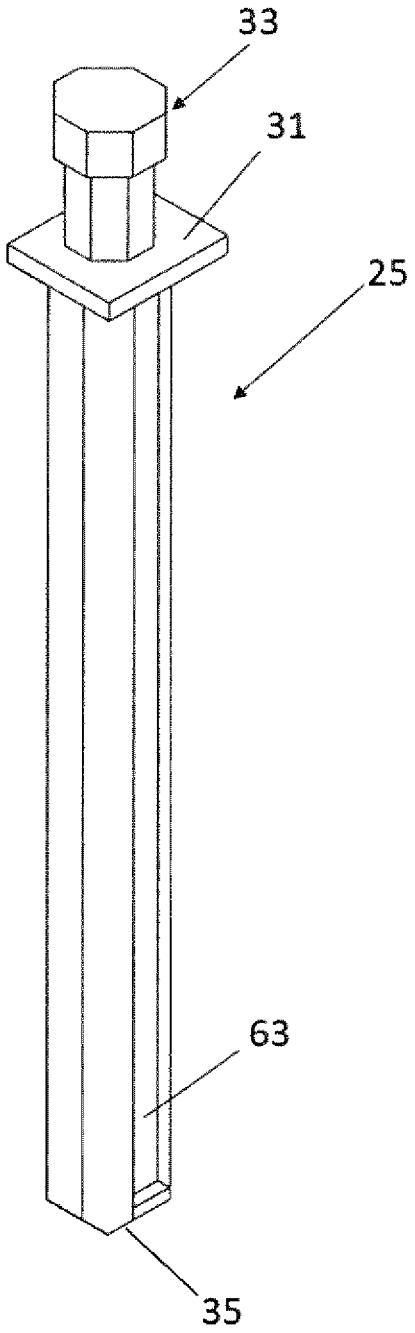
FIG. 6E shows a perspective view of the locking pin showing the slot therein.
Figure 6F:
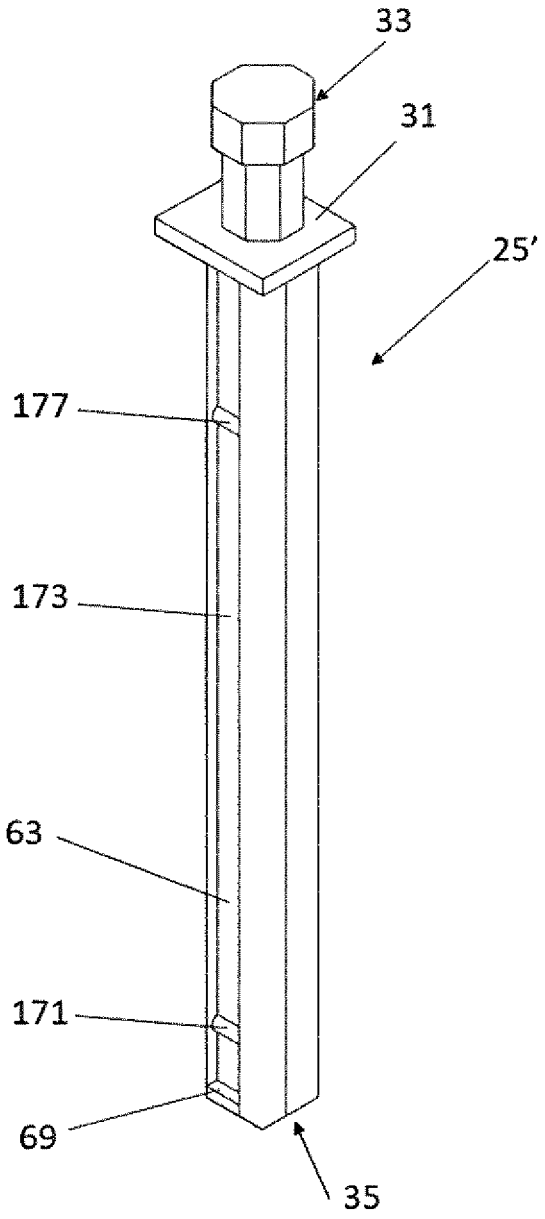
FIGS. 6F-6H show another embodiment of the locking pin shown in FIG. 6E.
Figure 6G:
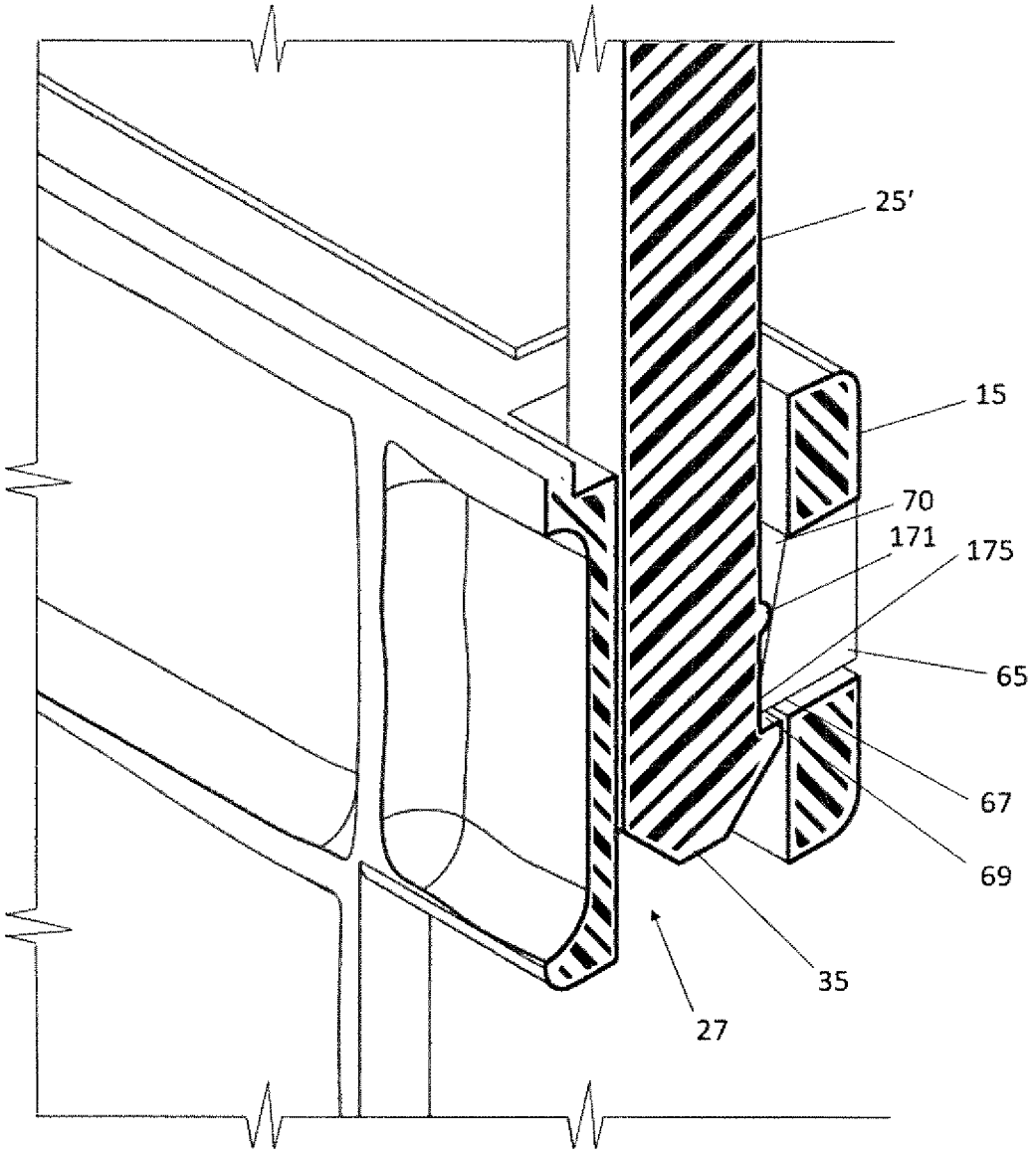
Figure 6H:
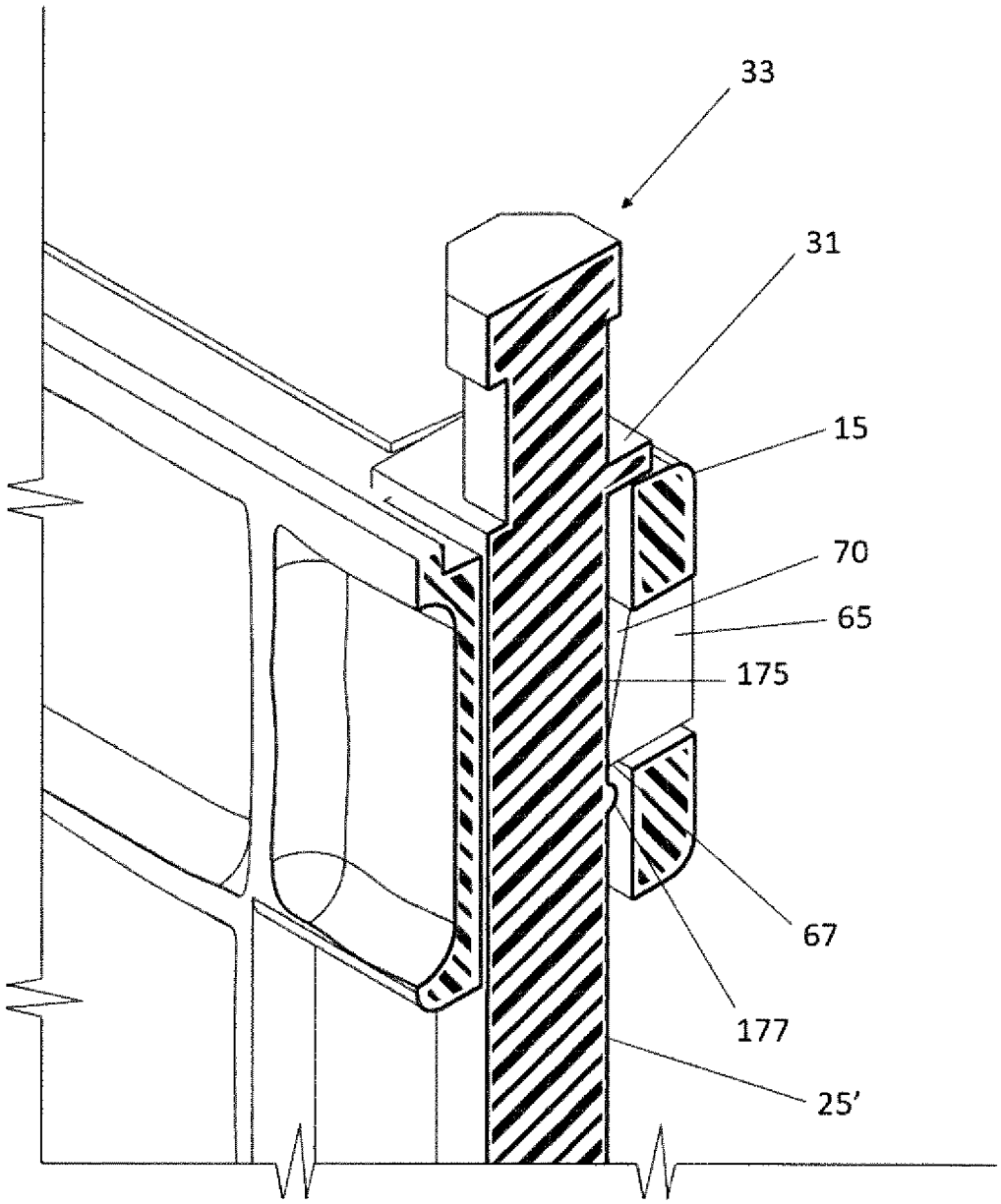

FIGS. 6F-6H shows another embodiment of the locking pin 25 of FIG. 6E. This embodiment has features or means to retain the locking pin in the retracted state as well as features or means to retain the locking pin when in the lowered state. Retaining the pin in the retracted state allows the pin to be held in place while two forms may be aligned for interlocking purposes. By holding the pin in the retracted state, one manipulating the forms for sand castle building does not have to hold the locking pin in place. Once the female connectors of the two forms are aligned, the pin can be moved to the lowered state to connect the two forms together.

With the locking pin in the lowered state, the feature or means holds the locking pin in the lowered state when it engages the female connectors of adjacent forms for interlocking the forms. With the holding feature, the locking pin cannot easily move back to a retracted state should the forms be positioned so that the locking pin could be upside down, and merely fall out of the connectors 14, 14', and 15'.

With reference to FIG. 6E, the locking pin 25' includes a rib 171 that is positioned transversely in the slot 63 near the bottom surface 69 of the slot 63. The extension of the rib from the base 173 of the slot is less than the extension of the bottom surface 69. Referring to FIG. 6G, this extension is enough to hold the pin 25' in the retracted state, with the rib 171 resting on the ramp 70 of the protrusion 65. The extension of the rib is not so much that when the pin 25' is moved into the retracted state from the lowered state by a force on the pin 25', whether from the top 33 or bottom 35, play between the locking pin 25', opening 27, and protrusion 65 will allow the rib 171 to slide over the free end 175 of the protrusion 65 and protrusion underside surface 67 when the 25' is being raised into the retracted state. Once the pin 25' is moved into the retracted state, the rib 171 can rest on the ramp 70, thereby keeping the pin 25' in the retracted state without any other holding force applied thereto.

When moving the pin 25' down into the lowered position from the fully retracted position, the ramp 70 and moveable protrusion 65 allows the rib 171 to pass over the protrusion 65 similar to the movement of the bottom portion 35 of the pin over the ramp as described above, see FIGS. 6C and 6D above, when the pin 25 is moved to the lowered state.

FIGS. 6G and 6H show the embodiment and means for keeping the pin 25' in the lowered state. The locking pin 25' has a second rib 177 that is positioned in slot 63 in a position near the top portion 31 of the pin 25'. The second rib 177 is sized similar to the rib 171 in that, when the locking pin 25' is raised and moved into the retracted state, the rib 171 also has to pass over the protrusion 65, its free end 175 and underside surface 65, this action being the same as when the rib 171 moves above the protrusion 65 as shown in FIG. 6F.

Referring to FIG. 6H, the pin 25' is shown in the lowered state, wherein the stop 31 rests on the top of the female connector 15. In this state, the rib 177 is positioned underneath the free end 175 and underside surface 67 of the protrusion 65. With the rib 177 in this position, the pin 25' cannot just freely slide in a retracted state direction. This restriction prevents the pin 25' from moving in the retracted state direction and possibly moving out of connectors 13, 13' of one form and connector 15' of the form including the locking pin 25' and having a disconnection between forms that could affect the sand castle being made.

It should be understood that the ribs are an optional feature and the interlocking forms could be used with the locking pin of FIG. 6E, just that more care could possibly be needed to monitor the movement of the locking pin 25 when interconnecting the various forms and sand castle creation.

Figure 6I:
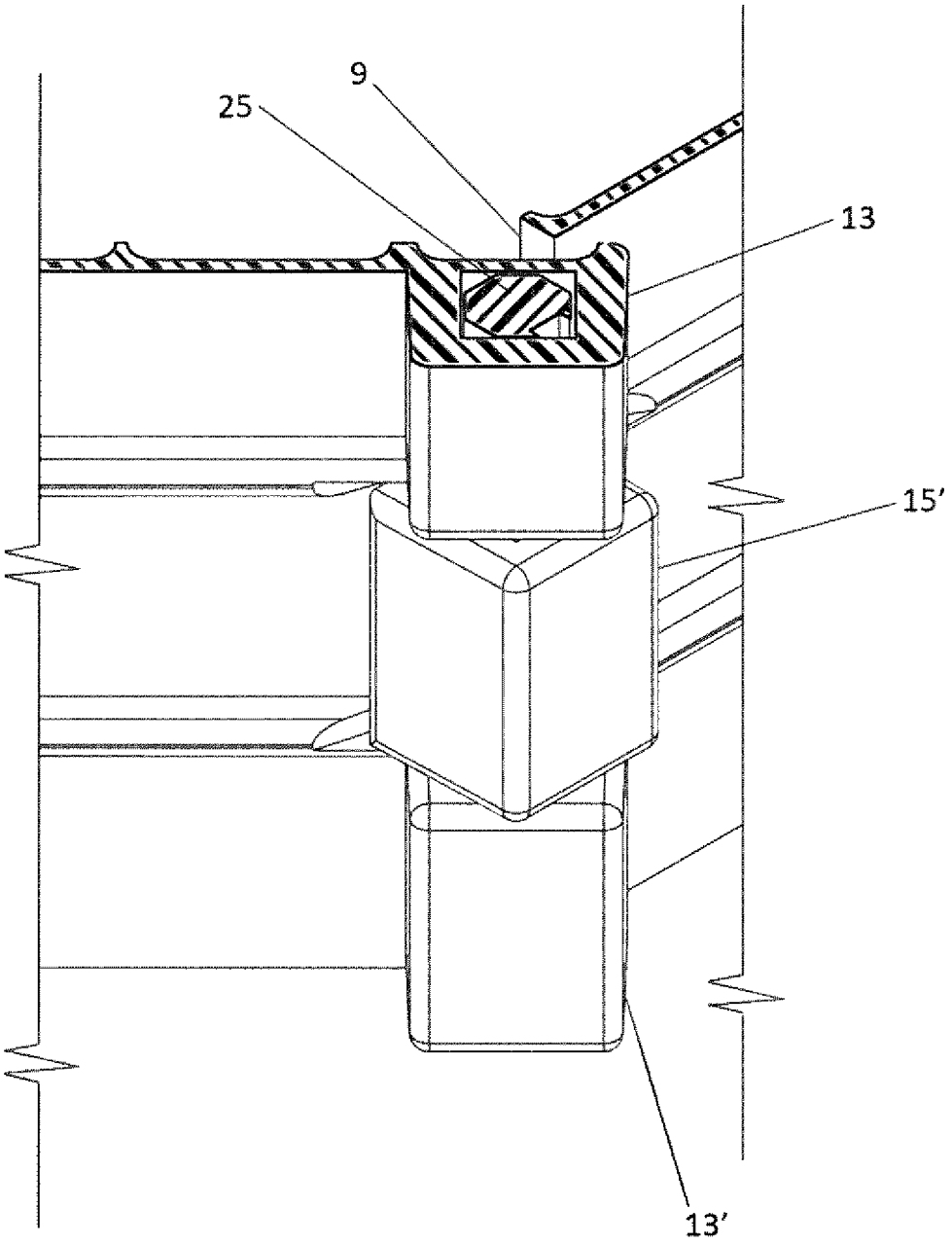
FIG. 6I shows a transverse cross section of a female connector showing an angled connection between interlocking forms.

FIG. 6I illustrate how the octagonal locking pin 25 shown in FIG. 6B facilitates connection of adjacent interlocking forms in different angled configurations. FIG. 6I shows a transverse cross section of a female connector 13 that would be positioned beneath the female connector 15 shown in FIG. 6B and in the space 19 between the connectors 15 and 15'. The female connector 13 can be positioned with respect to the locking pin 25 so that the body portion of the interlocking form with the female connector is at a 45 degree angle with respect to the body portion of the interlocking form having female connector 15. The octagonal shape of the locking pin 25 allows one to connect adjacent interlocking forms at various 45 degree increments, e.g., two forms can have their inside face at 90, 135, 180, 225, 270, or 315 degrees to each other. The female connectors 15 and 15' are positioned with enough of a clearance from the end portion 11 to allow the female connectors 14 and 14' to allow for the angled connection between the adjacent interlocking forms. The same clearance is provided with respect to the body end 9 and the female connectors 13 and 13'. The octagonal shape of the locking pin affords a large number of angulations when connecting adjacent interlocking form. However, fewer or more sides could be employed for the locking pin depending on the need or desire for the particular angulations between adjacent interlocking forms. While the openings 14 and 14' and 15 and 15' are shown with a square shape, wherein faces of the openings engage faces of the polygonal locking pin 25 when the locking pin is in the lowered state, to provide the anti-rotation and locking feature for the interlocking forms connected together in a predetermined angulation, the openings 14 and 14' and 15 and 15' could have other shapes that would provide the same anti-rotation and locking feature for the interconnected interlocking forms. The engagement of the faces to achieve the anti-rotation and locking feature of the female connectors of two adjacent interlocking forms as shown in FIG. 6I, is represented in FIG. 6*b*. Faces 72 of the locking pin 25 engage or face the faces 76 of the opening 27 in the female connector 15. This similar arrangement occurs between a locking pin and the other female connectors 15' and connectors 13 and 13' and their respective openings. Once the adjacent interlocking forms are positioned in a desired alignment, when putting the locking pin into the lowered state so that it passes through the openings in the connectors 13 and 15' and enters the opening in connector 13', the two adjacent interlocking forms are locked in place against rotation for sand structure building. It should be understood that the polygonal cross section shaped locking pin could be sized with respect to the openings in the female connector such that the faces of the pin and faces of the opening are touching or slightly spaced apart. Even if a slight spacing exists, the respective faces of the locking pin and openings would still resist rotation of the female connectors once the locking pin is positioned within the connector openings. Referring to FIG. 7 again, the connection between two adjacent interlocking forms 1 and 1' is shown. The connectors 15 and 15' and connectors 13 and 13' are identified for the interlocking form 1'. The connectors 13 and 13' would engage the connectors 15 and 15' of the interlocking form 1 shown on the right in FIG. 7, with the locking pin 25 that is part of the interlocking form 1 engaging the connectors 13 and 13' of the form 1' and connector 15' of the form 1 to link the interlocking forms 1 and 1' together.

Figure 6J:
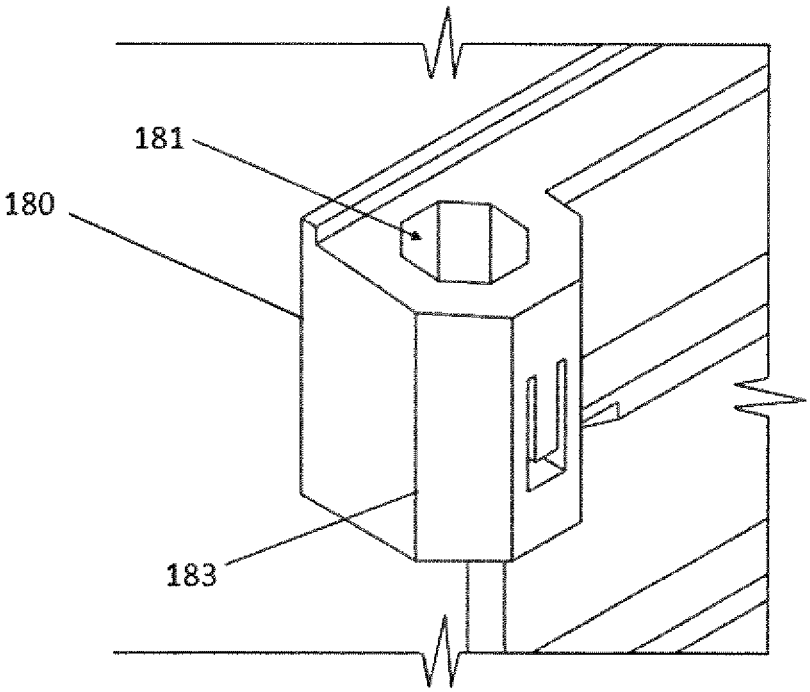
FIG. 6J shows another female connector configuration.

FIG. 6J shows another embodiment of the invention in terms of the configuration of the female connector. Instead of having a square connector opening as shown in FIG. 6I, a female connector 180 is shown with an octagonal opening 181 and octagonal outer configuration 183. Having the octagonal opening 181 allows a more secure mating with an octagonal locking pin when connectors of adjacent interlocking forms are connected together. In this embodiment, the outer configuration of the connector is shown to match that of the connector opening. However, since the outer configuration does not interact with the locking pin when connecting adjacent interlocking forms together, the outer configuration of the connector does not have to match the shape of the connector opening. For example, the square connectors shown in FIG. 6I could include an octagonal opening therein.

FIG. 8 depicts an exemplary arrangement of interlocking forms 1 and 1'. One advantage of the invention is the ability to disconnect some forms while leaving other forms connected. The coupled forms 1 and 1' designated by reference numeral 91 are separated from the coupled forms 1 and 1' designated by reference numeral 93. Similarly, the one form 1' designated by reference numeral 95 is separated from its adjacent forms. The combination of the female connectors and the octagonal connecting pin provides a sturdy and stable connection, ensuring the structural integrity of the sandcastle. The forms can be assembled and disassembled effortlessly, allowing for easy customization and modification of sandcastle designs. The locking pins are pulled up and the forms can then be easily pulled away from the sand structure and replaced with others of a different kind or allow a change in orientation of the form.

Figure 9:
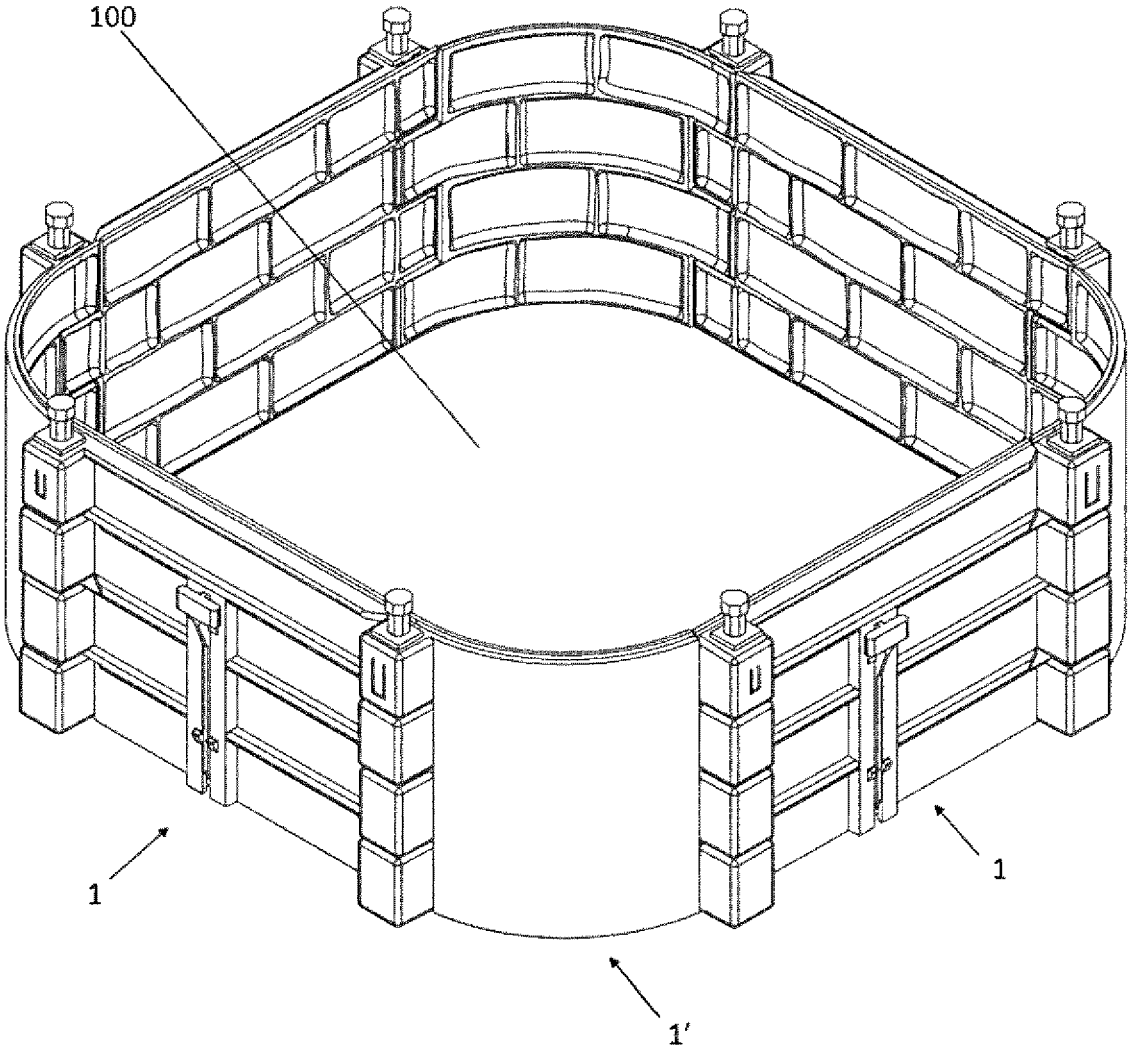
FIG. 9 shows a perspective view of an exemplary arrangement of interlocking forms for sand castle building.

FIG. 9 shows an example of interlocking forms 1 and 1' connected together to form an exemplary space 100 that can be filled with sand to create a sand castle or as part of creating a larger scale sand castle.

Figure 10:
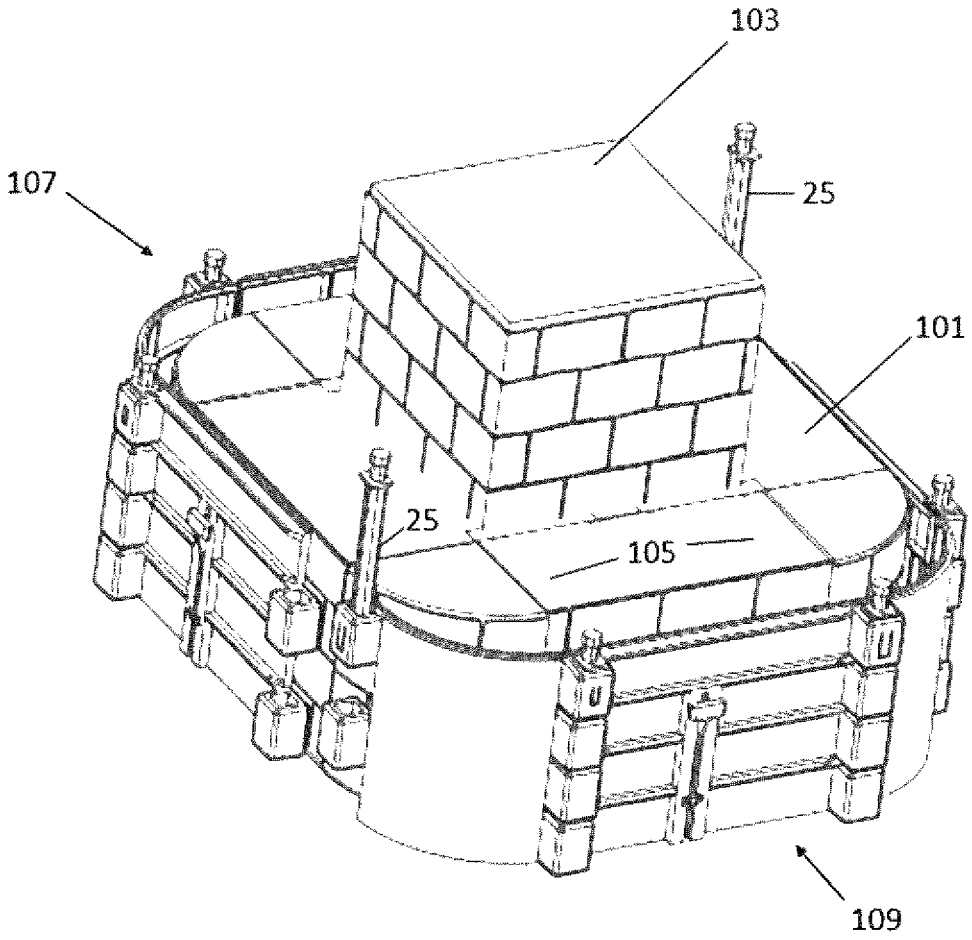
FIG. 10 shows the arrangement of interlocking forms of FIG. 7 in a partially disconnected state after sand has filled the space formed by the interlocking forms.

FIG. 10 shows the same combination of interlocking forms 1 and 1' as shown in FIG. 9. However, in this configuration, sand 101 is filled in space 100 and another sand castle creation 103 is formed on the top surface 105 of the sand 101. The sand castle creation 103 would have been formed by using four interlocking forms 1. FIG. 10 also shows the flexibility of the system in that complex shapes do not have to be completely disassembled when creating a sand castle. In FIG. 10, one half of the assembly of forms, which includes two forms 1 and two forms 1', is designated by reference numeral 107 and the other half of the assembly of forms is designated by reference numeral 109. By raising locking pin 25 of half 109 and locking pin 25 of half 107, each half assembly is easily separated from the sand 101.

The integration of the protrusion on the female connector and slot in the locking pin not only ensures a secure connection but also enhances the speed at which the forms can be created. With this design, users can quickly assemble and disassemble the forms without the need to constantly insert and remove the locking pins, streamlining the process of building sandcastles and saving valuable time. This design also eliminates the worry of losing any locking pins.

FIGS. 11A to 12B shows additional features of the inventive sand castle building system. FIGS. 11A to 11E show a tunnel or door forming assembly designated by the reference numeral 110, see FIG. 11E. The assembly 110 has a first section 111, with a front perspective view shown in FIG. 11A and a rear perspective view shown in FIG. 11B. The section 111 has a flange 113 with one side 115 having a surface configuration 117 representing a castle door-like structure, e.g., an arched stone doorway. The other side 119 of the flange 113 has a smooth sided surface 121 as there is no need to depict a castle-like surface. The section 111 also includes a tunnel portion 123 that extends from the flange 113 and terminates with an opening 125. The bottom of the tunnel portion 125 has a slot 127 therein. The flange 113 also has an opening 129 and a lip 131 that extends from the surface 121. The space between the surface 121 and lip 131 forms a channel 132 that is sized to engage the bottom of an interlocking form so that the surface 121 abuts the castle wall looking surface 7 of the interconnecting form and the section 111 is connected to the interconnecting form.

Figure 11A:
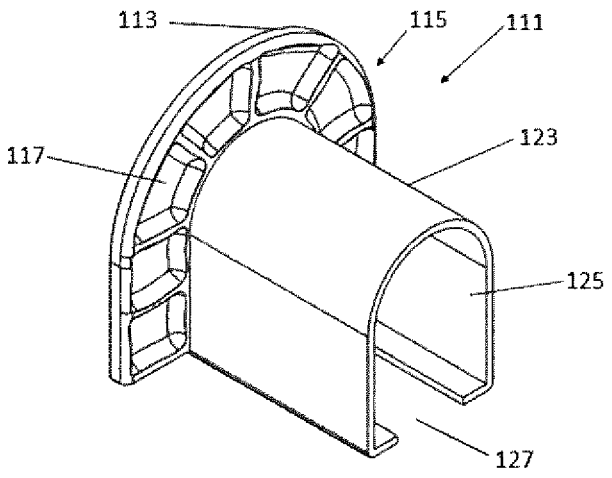
FIGS. 11A-E show the tunnel assembly of the inventive sand castle building system.
Figure 11B:
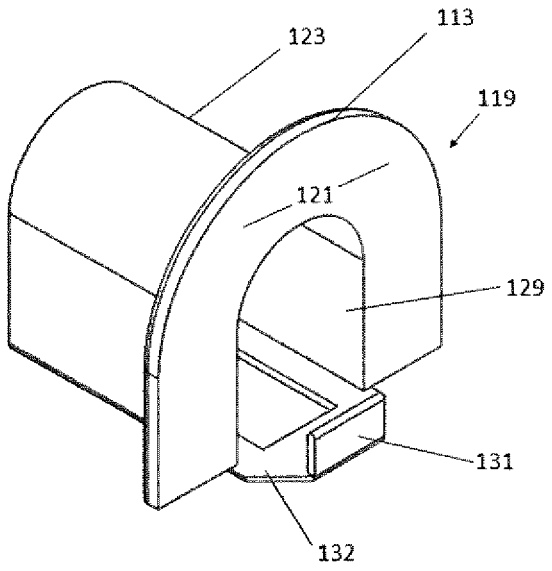
Figure 11C:
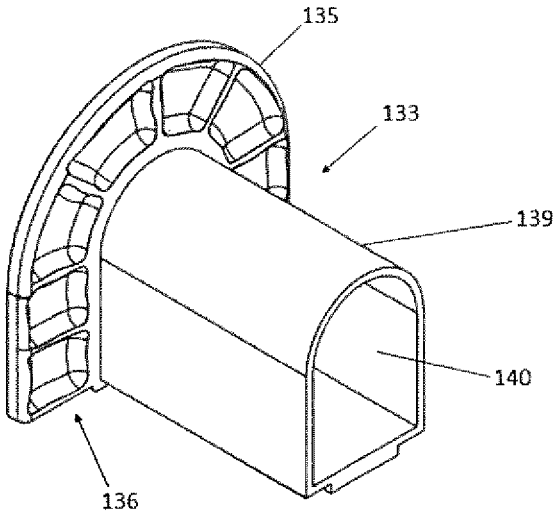
Figure 11D:
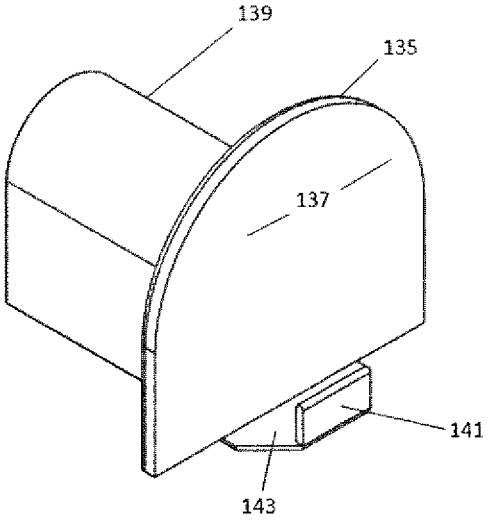
Figure 11E:
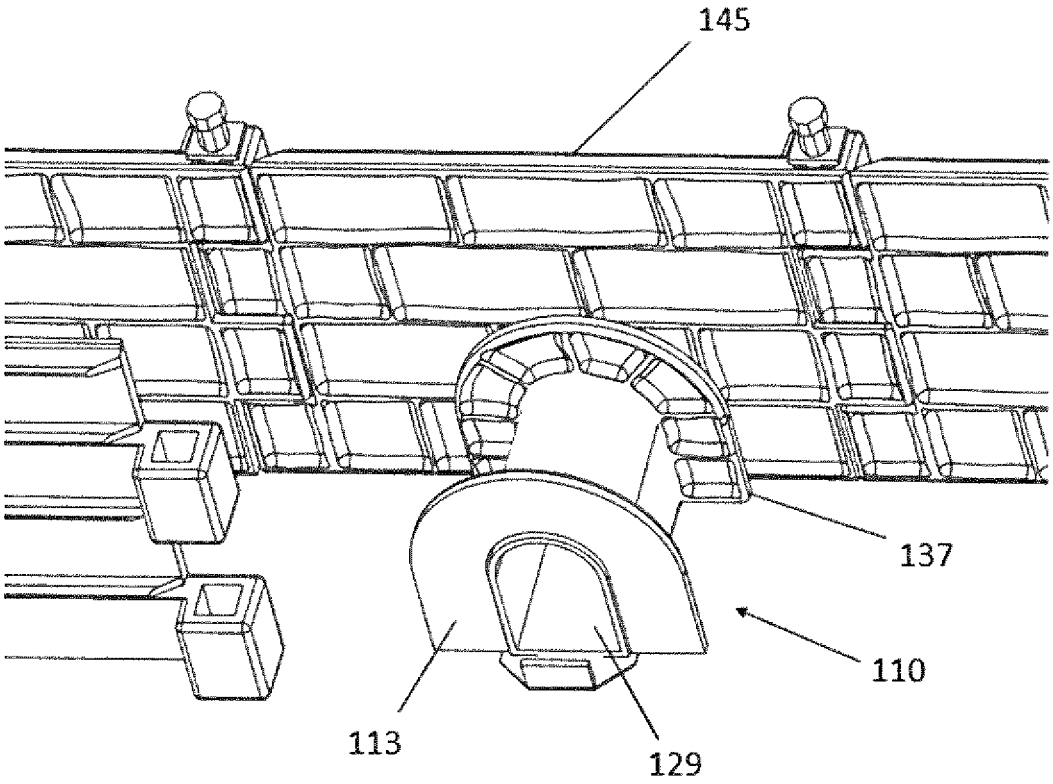

A second section of the assembly 110 is shown in FIGS. 11C and D and is designated by the reference numeral 133. This second section also has a flange 135 configured in a similar manner as flange 113 of section 111, one side having the castle wall looking configuration 136 and the other side having a smooth surfaced face 137. The section 135 also includes a tunnel portion 139 with a tunnel 140 formed thereby. As seen in FIG. 11D, a lip 141 is provided, similar to the lip 131 in FIG. 11B, the lip 141 and surface 137 forming a channel 143, also designed to engage the bottom of another interlocking form. The tunnel portion 139 is sized to slide into the opening 125 of the section 111 as shown in FIG. 11E. The flange 137 does not have an opening as it is designed to abut the inner surface of an interlocking form with the tunnel opening 140 that terminates at the closed flange 137 forming an opening in the wall of the sand castle as detailed below.

The tunnel assembly 110 allows the formation of a tunnel through a pair of interconnecting forms that are spaced apart but in parallel orientation. It also represents the ability to create a gate or door-like look on the surface of the sand surrounding the tunnel that is ultimately formed by the tunnel assembly. One interlocking form is shown as 145 in FIG. 11E, wherein the flange 137 abuts the inner surface of the interlocking form 145. While not shown in FIG. 11E, another interlocking form would abut the flange 113 and engage the channel 132. As sand would fill the space between the two interlocking forms having the tunnel assembly 110 connected thereto, once the interlocking forms 1 would be removed, the tunnel assembly 110 separated and removed, leaving wall formed between the two interlocking forms, the opening 129 in the flange 113 would then be one door opening in the sand castle wall and the opening formed by tunnel portion 139 and its tunnel at the face of the flange 137 would form a second door opening once the interlocking form is removed.

Figure 12A:
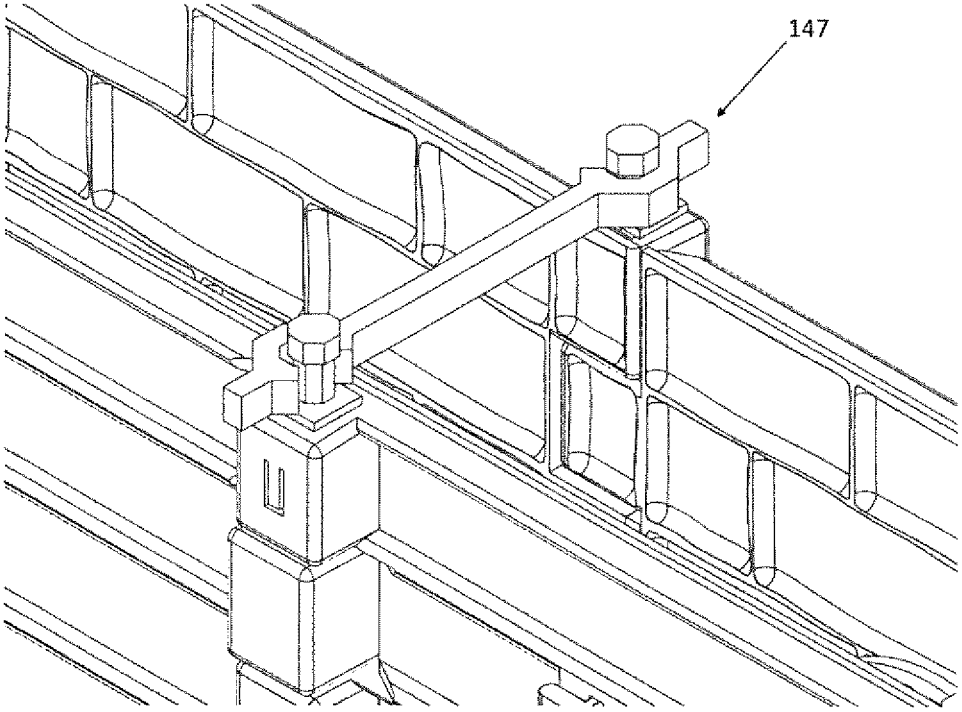
FIGS. 12A and 12B shows a brace for use in the inventive sand castle building system.
Figure 12B:
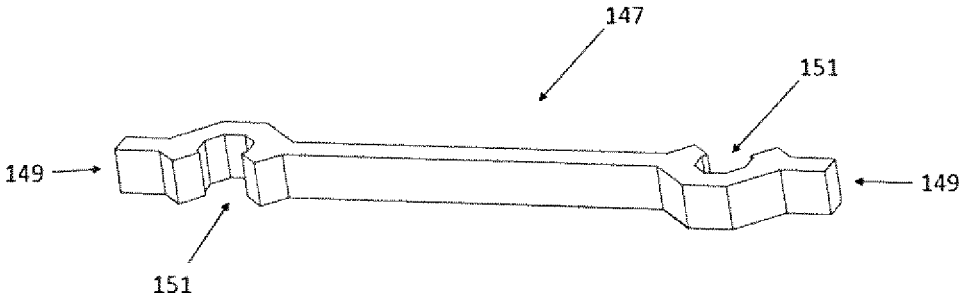

FIGS. 12A and 12B show another feature of the invention as a brace 147. The brace 147 has opposing ends 149, each end 149 having a cut out 151, which is sized to receive the top part 33 of the locking pin 25. The cutouts 151 are shown with opposite orientations to better prevent the brace from being dislodged from the locking pins. The brace 147 is useful when the sand being used to create the sand castle is wet and heavy. This kind of sand can make it difficult to maintain the forms in a vertical orientation and using the brace to interconnect two locking pins helps keep the interlocking forms to be vertical, resulting in vertical sand castle walls.

FIG. 13 is another example of an arrangement of the interlocking forms, which is designated by the reference numeral 160. Here, a stacked arrangement of interlocking forms 1 and 1' are depicted by reference numerals 161 and 163, respectively. The half size interlocking form 1" is also employed in certain places, which are designated by reference numeral 165. FIG. 13 shows the myriad design opportunities to build a sand castle of epic portions and configurations.

While the interlocking forms are shown with pairs of female connectors, more connectors could be employed if so desired. For example, the interlocking forms could include three or more connectors, even six connectors on each end portion of the body portion, more like a piano hinge. In other words, the interlocking forms would have at least two female connectors on each end of the body portion but the forms are not limited to just two connectors on each side.

The invention also entails a kit that would include a plurality of the various interlocking forms described above, the tunnel assembly, and braces so that the pieces of the kit can be arranged in an interconnected pattern to allow spaces between the forms to be filled with sand for sand castle creation.

The invention also includes a method of building a sand castle by taking a number of the different forms described above, including if desired the tunnel assembly and braces, and interconnecting them together to form a space to be filled with sand. Once the spaces are filled, the forms can be separated and removed by raising of the locking pins of the forms, one by one or removal in sections of interconnected forms, depending on the desire of the sand castle builder. As described above, the use of the polygonal locking pin and its interaction with the particularly-shaped female connector openings allows a builder to position adjacent interlocking forms in a particular orientation, forms aligned in a straight manner, forms at right angles, and the like. This is accomplished by raising the locking pin, so that female connectors 13 and 13' of one interlocking form would engage the spaces 19 and 23 associated with the female connectors 15 and 15' of another interlocking form. The two interlocking forms are their appropriately positioned with respect to each other, angled, aligned, etc. Once the two interlocking forms are positioned in the desired alignment, the locking pin is moved to its lowered state. With the polygonal nature of the locking pin and the polygonal nature of the openings 14 and 14', a square opening as an example, the side faces of the polygonal pin engage with or face the interior faces of the openings 14 and 14' and the connectors are locked against rotation in the designated position for sand structure building. Moving the locking pin to its retracted state then allows the interlocking forms to be either disengaged for form separation or moved with respect to each other to form a different angulation between the interlocking forms as the builder would so desire.

The sandcastle building system offers several key advantages that revolutionize the process of creating sandcastles and enhance the overall experience for users of all ages. These advantages open various applications and possibilities for sandcastle enthusiasts and builders:

1. Versatile Construction: The interlocking forms with female connectors and octagonal connecting pins enable the construction of sandcastles in different shapes and sizes. Builders can easily connect and disconnect the forms, allowing for endless customization and modification of sandcastle designs.
2. Structural Integrity: The combination of female connectors and connecting pins provides a sturdy and stable connection, ensuring the structural integrity of the sandcastle. Builders can construct elaborate and intricate designs with confidence, knowing that their creations will maintain their shape and withstand the elements.
3. Easy Removal of Forms: With the locking pins in the raised position, the interlocking forms can be tilted away from the remaining sand castle structure and removed at an angle, leaving the sand castle structure intact and undisturbed during form removal.
4. Effortless Assembly and Disassembly: The innovative design of the forms allows for effortless assembly and disassembly. With the catch mechanism and notch on the anchor peg, builders can quickly connect and disconnect the forms without constantly inserting and removing the pegs. This streamlined process saves valuable time and eliminates the worry of losing the pegs.

5. Efficient Sand Filling: The anchor peg serves as a valuable tool during the sand filling process. By pushing the peg down into the sand, builders can secure the form in place, preventing shifting or collapsing. This feature ensures precise and accurate construction, maintaining the intended shape of the sandcastle.
6. Stackable Design: The unique stacking capability of the forms allows builders to create multi-level sandcastle structures with ease. The nesting mechanism, where the tops of the connector pins fit inside the bottom of the female connectors, ensures a firm and secure connection between stacked forms. This feature enables the creation of larger and more intricate sandcastles, expanding creative possibilities.
7. Expandable Structures: Builders can expand their sandcastle structures by reconfiguring and connecting new sections using the forms from completed sections. This flexibility allows for the creation of large-scale sandcastles without the need for additional forms, offering both convenience and the ability to build impressive structures.
8. Improved Sand Release: Unlike traditional buckets that often create a vacuum effect, hindering the release of sand when upended, the sandcastle building system overcomes this limitation. The interlocking forms allow for a smooth and efficient release of sand, ensuring that builders can easily fill and shape their sandcastles without any obstructions or frustrating sand traps. This innovation promotes a seamless sandcastle-building experience and eliminates the limitations posed by traditional bucket designs.

The sandcastle building system is ideal for a wide range of applications. Whether it's a fun day at the beach, a sandcastle competition, or an educational activity, the intuitive design and versatility of the forms make them suitable for builders of all ages. Children and adults alike can engage in imaginative play, foster creativity, and experience the joy of constructing their own sandcastles using this innovative system.

While the interlocking forms can include features to mimic a sand castle outer wall, the interlocking forms could include features that mimic other structures. For example, the surface 7 could just employ horizontal protrusions 39 so that a lath or board-like look would be imparted to the sand when constructing a particular sand structure. In other words, while building a sand castle is a preferred aim through the use of the interlocking forms and other component parts of the kit, other sand structures could be constructed with interlocking forms having different configurations on the surface 7 intended to be in contact with sand.

The embodiment using the octagonal pin for anti-rotation and locking purposes can be combined with the means for retaining the locking pin with the interlocking form. However, the interlocking pin would be configured to just have its polygonal cross sectional shape and not include features to keep the locking pin retained with the interlocking form and held in either of both of the retracted state and lowered state. In this embodiment, the locking pin is effectively removable from the interlocking form and only provides the anti-rotation and locking feature described above.

As such, an invention has been disclosed in terms of preferred embodiments thereof which fulfills each and every one of the objects of the present invention as set forth above and provides a new and improved sand castle building system, an interlocking form as a part thereof, a method of building sand castles using the system and forms, and a kit includes the various forms and other component parts of the system.

Of course, various changes, modifications and alterations from the teachings of the present invention may be contemplated by those skilled in the art without departing from the intended spirit and scope thereof. It is intended that the present invention only be limited by the terms of the appended claims.

I claim:

1. An interlocking form for use in building sand structures comprising:

a body portion having opposing first and second end portions and first and second surfaces, one of the first and second surfaces having first protrusions extending therefrom to simulate a wall structure, the first end portion including first and second spaced apart female connectors and the second end portion including third and fourth spaced apart female connectors;

a locking pin comprising a top portion, body portion, and end portion, the body portion sized to slide in an opening in the first female connector and in an opening in the second female connector such that the end portion can extend from a bottom of the second female connector when the locking pin is in a lowered state and be positioned in the opening of the first female connector when the locking pin is in a retracted state; and means for retaining the end portion of the locking pin in the opening in the first female connector by engaging the end portion of the locking pin within the opening to keep the locking pin and body portion together when the locking pin is in both the retracted and lowered states when the interlocking form is used for sand structure building.

2. The interlocking form of claim 1, wherein the body portion is curved or straight.

3. The interlocking form of claim 1, wherein the retaining means further comprises:

a slot in the locking pin, the slot including a bottom surface; and a moveable protrusion in the first female connector, the moveable protrusion having a ramp terminating at a free end portion of the moveable protrusion, the ramp and free end portion extending into the opening in the first female connector, movement of the moveable protrusion allowing the end portion and body portion of the locking pin to pass through the opening in the first female connector, the free end portion of the moveable protrusion engaging the bottom surface of the slot to retain the end portion of the locking pin in the first female connector.

4. The interlocking form of claim 1, further comprising means for holding the locking pin in the first female connector when the locking pin is in the retracted state.

5. The interlocking form of claim 4, further comprising a means for holding the locking pin in the first female connector when the locking pin is in the lowered state.

6. The interlocking form of claim 4, wherein the retaining means further comprises:

a slot in the locking pin, the slot including a bottom surface; and a moveable protrusion in the first female connector, the moveable protrusion having a ramp terminating at a free end portion of the moveable protrusion, the ramp and free end portion extending into the opening in the first female connector, movement of the moveable protrusion allowing the end portion and body portion of the locking pin to pass through the opening in the first female connector, the free end portion of the moveable protrusion engaging the bottom surface of the slot to retain the end portion of the locking pin in the first female connector, and the retracted state holding means further comprising a first rib positioned in the slot near the end portion of the locking pin and configured to engage the ramp of the moveable protrusion to prevent the locking pin from moving to the lowered state once in the retracted state.

7. The interlocking form of claim 1, further comprising a means for holding the locking pin in the first female connector when the locking pin is in the lowered state.

8. The interlocking form of claim 7, wherein the retaining means further comprises:

a slot in the locking pin, the slot including a bottom surface; and a moveable protrusion in the first female connector, the moveable protrusion having a ramp terminating at a free end portion of the moveable protrusion, the ramp and free end portion extending into the opening in the first female connector, movement of the moveable protrusion allowing the end portion and body portion of the locking pin to pass through the opening in the first female connector, the free end portion of the moveable protrusion engaging the bottom surface of the slot to retain the end portion of the locking pin in the first female connector, and the lowered state holding means further comprising a second rib positioned in the slot near the top portion of the locking pin and configured to engage the free end portion of the moveable protrusion to prevent the locking pin from moving to the retracted state once in the lowered state.

9. The interlocking form of claim 8, the lowered state holding means further comprising a second rib positioned in the slot near the top portion of the locking pin and configured to engage the free end portion of the moveable protrusion to prevent the locking pin from moving to the retracted state once in the lowered state.

10. The interlocking form of claim 1, wherein the other of the first and second surfaces has second protrusions extending therefrom for strengthening purposes.

11. The interlocking form of claim 1 further comprising an anchor peg assembly, the anchor peg assembly including an anchor peg housing mounted to the other of the first and second surfaces of the body portion, the anchor peg housing including a slot to slidably receive an anchor peg, the anchor peg capable of extending from the slot to extend beyond a bottom of the body portion and penetrate sand to provide stability to the interlocking form, and means for retaining the anchor peg in a storage position and means for keeping the anchor peg in the slot once inserted therein.

12. The interlocking form of claim 1, wherein the locking pin has a polygonal shape in cross section.

13. A sand structure building kit comprising a plurality of the interlocking forms of claim 1, wherein a first set of interlocking forms each have a straight body portion, a second set of interlocking forms each have a curved body portion, and a third set of interlocking forms each have a length less than length of the interlocking form of the first set.

14. The kit of claim 13, further comprising a plurality of braces, each brace having a connector on each end, each connector configured to engage the top portion of a locking pin to brace spaced apart interlocking forms.

15. The kit of claim 13, further comprising a tunnel assembly, the tunnel assembly comprising:

a first section having a first flange at an end thereof and a first tunnel portion, one side of the first flange having protrusions to simulate a castle door opening;

a second section having a second flange at an end thereof and a second tunnel portion, one side of the second flange having protrusions to simulate a castle door opening, the second tunnel portion sized to fit within the first tunnel portion; and each of the first and second sections including a clip configured to engage a bottom of an interlocking form.

16. The kit of claim 15, further comprising a plurality of braces, each brace having a connector on each end, each connector configured to engage the top portion of a locking pin to brace spaced apart interlocking forms.

17. A method of constructing a sand structure comprising:

providing the kit of claim 13, connecting at least some of the interlocking forms of the kit together by engaging the locking pin of selected interlocking forms of the kit with female connectors of other selected interlocking forms of the kit, the connected interlocking forms creating one or more spaces with the first or second surface having the first protrusions facing the one or more spaces;

filling the one or more spaces with sand; and disconnecting the connected interlocking forms to leave a sand structure.

18. The method of claim 17, wherein the kit includes braces, each brace having a connector on each end, each connector configured to engage the top portion of a locking pin to brace spaced apart interlocking forms, and attaching the connectors of at least one brace to top portions of spaced apart interlocking forms to stabilize the spaced apart interlocking forms.

19. The method of claim 17, wherein the kit includes at least one tunnel assembly, the tunnel assembly comprising a first section having a first flange at an end thereof and a first tunnel portion, one side of the first flange having protrusions to simulate a castle door opening, a second section having a second flange at an end thereof and a second tunnel portion, one side of the second flange having protrusions to simulate a castle door opening, the second tunnel portion sized to fit within the first tunnel portion; each of the first and second sections including a clip configured to engage a bottom of an interlocking form; and positioning the tunnel assembly in a space between two spaced apart interlocking forms;

filling the space containing the tunnel assembly with sand; and removing the two spaced interlocking forms having the tunnel assembly therebetween and then removing the first and second sections of the tunnel assembly to create door openings in the sand filled in the space containing the tunnel assembly.

* * * * *